US006020824A

United States Patent [19]

Tamura et al.

[11] Patent Number: 6,020,824

[45] Date of Patent: Feb. 1, 2000

[54] PANEL INSTRUMENT

[75] Inventors: Hiroshi Tamura; Shigeru Shibasaki; Minoru Murayama; Takayuki Hamada, all of Tokyo, Japan

[73] Assignee: Yokogawa Electric Corporation, Tokyo, Japan

[21] Appl. No.: 08/730,428

[22] Filed: Oct. 15, 1996

[30] Foreign Application Priority Data

| | | | |
|---|---|---|---|
| Oct. 27, 1995 | [JP] | Japan | 7-280421 |
| Feb. 8, 1996 | [JP] | Japan | 8-022252 |
| Feb. 23, 1996 | [JP] | Japan | 8-036505 |
| Feb. 23, 1996 | [JP] | Japan | 8-036506 |
| Feb. 23, 1996 | [JP] | Japan | 8-036507 |
| Feb. 26, 1996 | [JP] | Japan | 8-037901 |
| Feb. 26, 1996 | [JP] | Japan | 8-037902 |
| May 16, 1996 | [JP] | Japan | 8-121516 |
| Jun. 25, 1996 | [JP] | Japan | 8-164358 |

[51] Int. Cl.[7] ..... G09F 3/04

[52] U.S. Cl. ..... 340/815.5; 340/815.4; 340/815.45; 340/815.47; 340/815.48; 340/815.49; 174/35; 361/679; 361/796

[58] Field of Search ..... 340/815.5, 815.4, 340/815.47, 815.48, 815.49, 815.74, 815.45; 200/314, 303, 302.1; 236/46 R; 361/679, 724, 725, 726, 796; 439/352, 354

[56] References Cited

U.S. PATENT DOCUMENTS

| | | | |
|---|---|---|---|
| 4,235,368 | 11/1980 | Neel | 200/314 |
| 4,267,966 | 5/1981 | Neel et al. | 364/528.13 |
| 4,300,199 | 11/1981 | Yoknis et al. | 236/46 A |
| 4,749,832 | 6/1988 | Schlosser | 200/302.1 |

*Primary Examiner*—Jeffery A. Hofsass
*Assistant Examiner*—Davetta Woods
*Attorney, Agent, or Firm*—Moonray Kojima

[57] ABSTRACT

A panel instrument apparatus of reduced size, comprising a printed circuit board on which light emitting elements and switches are mounted, and a panel cover to the rear of which the front face of the printed circuit board is attached. The panel cover comprises reflecting holes arranged in positions corresponding to the light emitting elements on the printed circuit board to guide light from the light emitting elements to the surface of the panel cover; and furthermore comprises resilient links and coupled thereto keys which are located in positions corresponding to the switches on the printed circuit board.

20 Claims, 24 Drawing Sheets

PANEL INSTRUMENT

BACKGROUND OF THE INVENTION

1. Field of Invention

This invention relates to a panel instrument, such as mounted on a panel; and more particularly, to such panel instrument of reduced size.

2. Description of Related Art

A panel instrument, for example, a temperature controller, has a plurality of switches and displays on the front surface thereof, and has formed at the rear thereof a plurality of terminal boards, which are connected to internal printed circuit boards. Examples of such panel instruments are disclosed, for example in Japanese Laid Open Applications UM SN H3-124,692 (1991); H5-79,435 (1993); H5-87,524 (1993); H6-45,338 (1994); Japanese Patent H7-209,095 (1995); Japanese U.M. H7-16,975 (1995); H7-25,625 (1995); and H7-43,612 (1995). With the advance of technology, the size of the panel instrument has become smaller. However, impeding the reduction of size of such panel instruments are such factors as discussed below.

Display

In panel instruments, the visibility of display numerals, and the like, is not very good and so an enlarged display thereof is needed. However, currently, there is a limit on the size of the numerals and symbols being displayed. To provide enlarged symbols and the like for display, the case itself must also be enlarged. Also, since 7-segment display modules are of large vertical dimension, the height of the entire display being determined corresponding to the height of the 7-segment display module is also large, even though the height of the switches, and the like, is not great. Consequently, this factor interferes with the reduction in size of the panel instrument.

Waterproof and Dustproof Properties

Finger guards are usually provided for case terminals to satisfy safety standards. Such an arrangement is shown, for example, in Japanese UM H3-124,482(1991). However, in most cases, the mounting area is limited due to the presence of the finger guards so that reduction in size is impeded.

Thus, it is desirable to eliminate finger guards and yet still comply with safety standards. The prevailing safety standards require that the front cover cannot be removed manually and that the knob covers be made to be of small size. If, however, the knob covers are made smaller, the knobs cannot be readily moved because the rubber packing usually used therewith does not deform readily. Thus, if the knobs are forced, there is likely to be breakage of the rubber packing. In that case, waterproof and dustproof properties may become degraded.

Terminal Board

Even if the panel instrument is made smaller, the same number of terminals must be provided. Since usually one of the terminals has a thermocouple connected thereto for temperature measurement, temperature compensation is provided by measuring the terminal temperature using a sensor. Thus, space must be provided for such sensor which causes reduction in space for the other terminals. Also, since the temperature measured by the sensor is often different from the actual terminal temperature, errors may occur in the temperature measured by the thermocouple.

Moreover, with the reduction in size of the panel instrument, the density of electronic components mounted on the printed circuit boards (also know as "cards") is increased. Thus, the same number of boards or cards cannot be used as terminal rows at the rear because of the large dimensioned components, such as transformer and/or capacitors.

In order to improve the foregoing situation, it was proposed that the cards be connected to terminal rows and be disposed parallel to a card on which components were densely mounted using studs and that the electrical connections be made with connectors. However, the space problem was not entirely solved because the studs and connectors required added space, and such added space requirement raised more problems than solved, because size still could not be reduced.

Furthermore, since crimp-on terminal lugs are connected to the terminals of the panel instruments, clearance must be provided between the terminal rows to prevent the terminal lugs from touching the terminal screws. For this reason, reducing the size of the panel instruments in the prior art, required a limit on the number of terminals, which itself again produced more problems than solved.

In addition, since wiring, or the like, may sometimes be performed at the rear of a panel, as a safety measure, it is necessary to attach a cover which does not touch the terminals of the panel instruments. Mounting a terminal cover on the rear of the panel instrument with screws decreases the space for the mounting terminals. In turn, this prevents use of the required number of terminals for a large panel instrument, which factor impedes the reduction of the size of the panel instrument.

Heat Dissipation

Reduction of size of the panel instrument increases correspondingly, the heat dissipation per unit area. This necessitates the provision of heat radiation holes on the top surface of the panel instrument. However, the air surrounding the panel instrument may be surrounded with dust or the like. Thus, use of air holes may cause more problems, such as contamination of the inside with the dust, electrical short circuiting and fire, clogged air holes from the dust, degradation of heat dissipation,and reduced life of the electronic components.

SUMMARY OF THE INVENTION

Accordingly, an object of the invention is to overcome the aforementioned and other deficiencies and disadvantages of the prior art.

Another object is to provide a panel instrument which can be reduced in size without sacrificing any of the desired characteristics of the panel instrument.

DETAILED DESCRIPTION OF THE PREFERRED EMBODIMENTS

Figure 1:
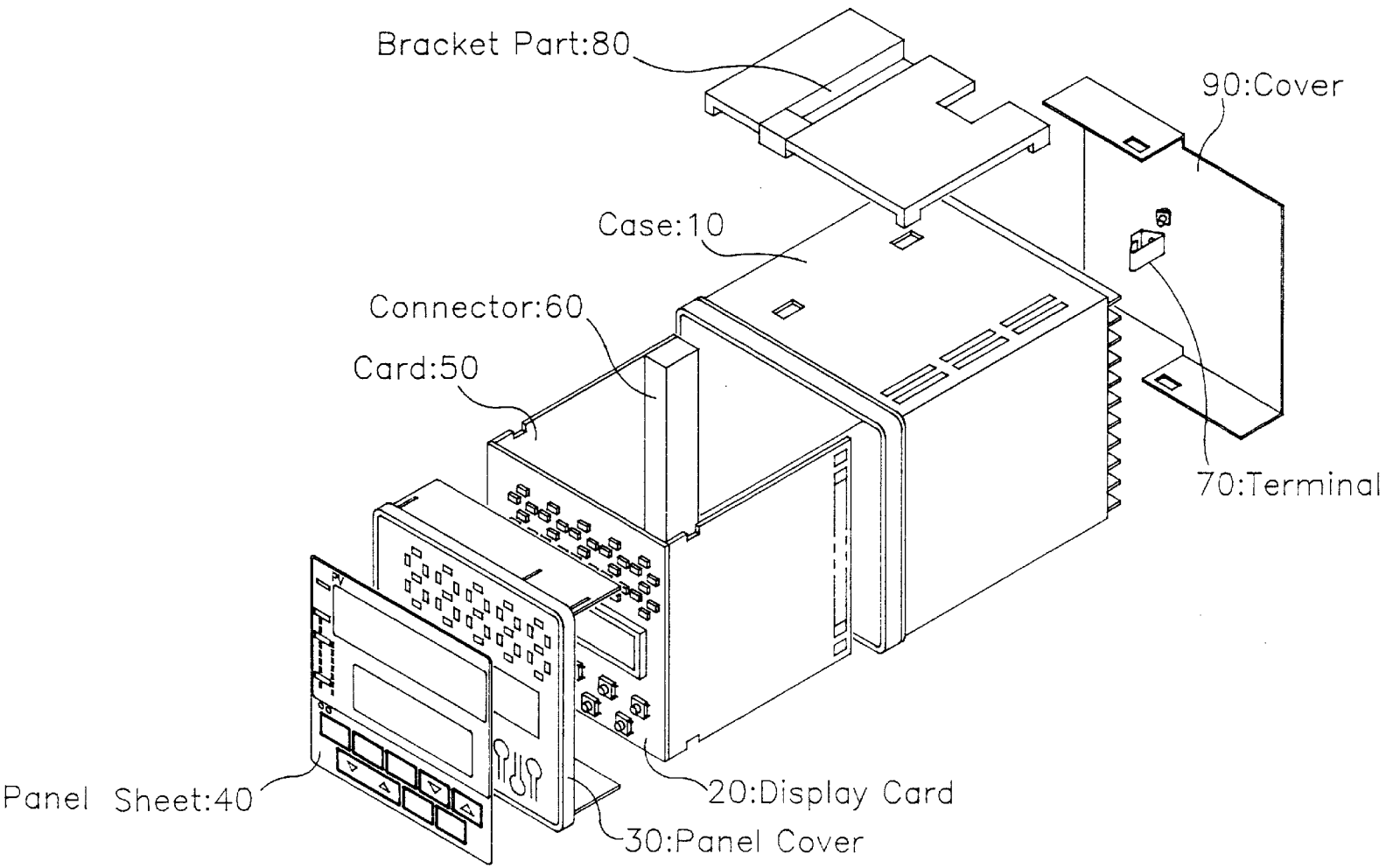
FIG. 1 is an exploded perspective view of an illustrative first embodiment of the invention.

FIG. 1 shows a panel instrument apparatus comprising a case 10, a printed circuit board 20 (also called "card"), a panel cover 30, a panel sheet 40, a card 50, a connector 60, terminals 70, bracket 80, and a cover 90. Although two cards 50 are shown herein, in the actual embodiment, four cards 50 are used. The invention will now be described in further details with reference to the different components thereof, namely (1) Display, (2) Panel sheet, (3) Packing, (4) Terminal board (A), (5) Terminal board (B), (6) Terminal board (C), (7) Terminal cover, and (8) Brackets.

Display

Figure 2:
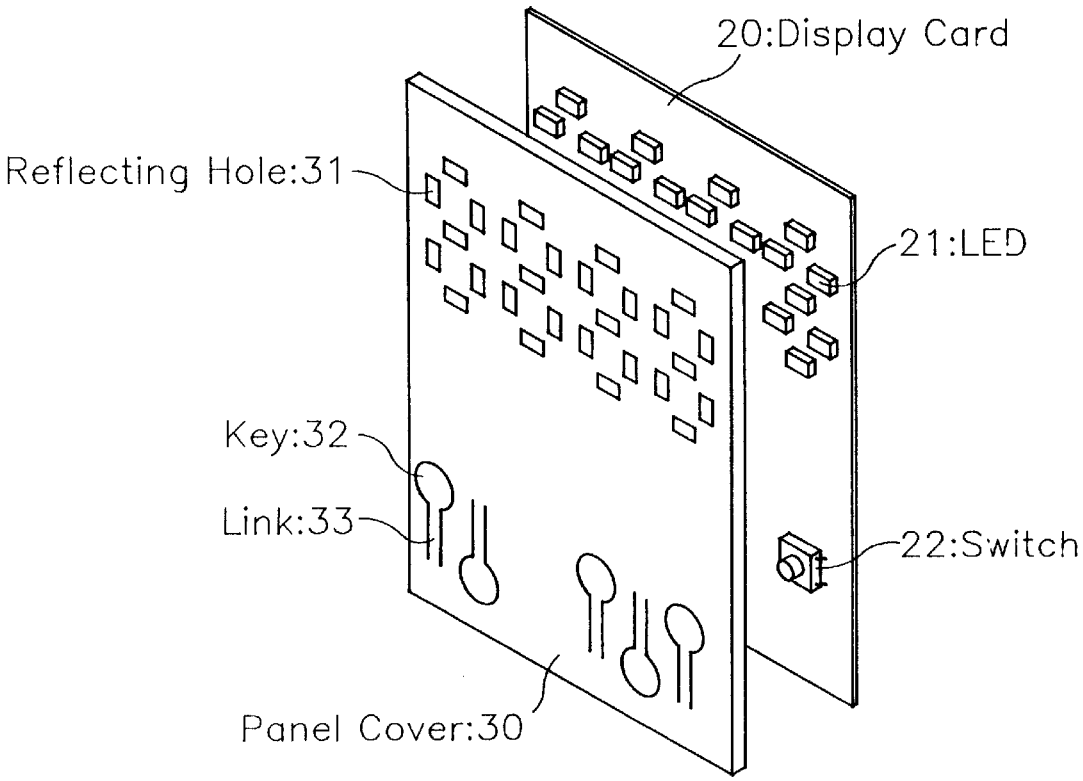
FIG. 2 is a perspective view depicting details of the panel cover of the embodiment of FIG. 1.
Figure 3:
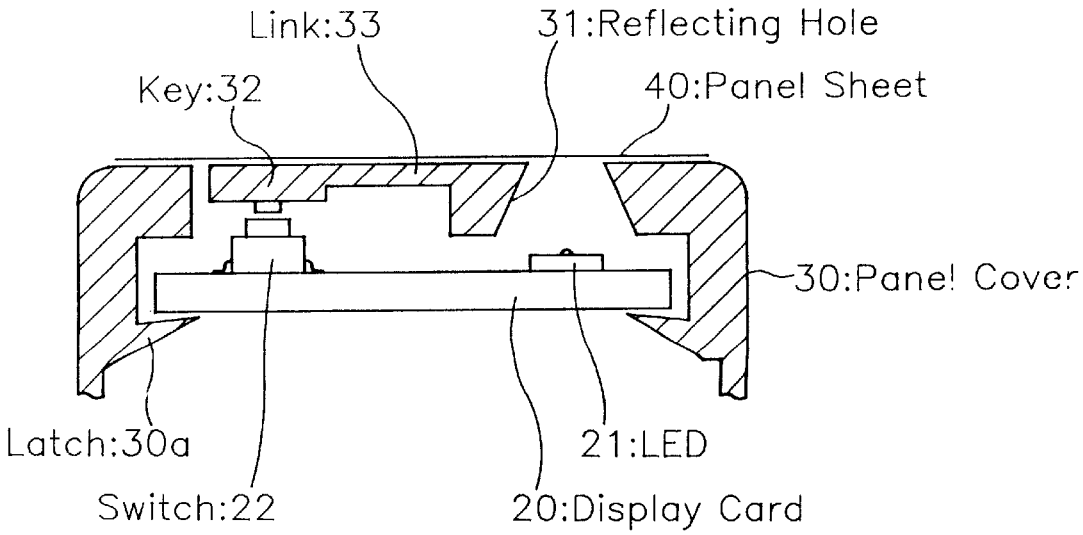
FIG. 3 is a cross sectional view depicting details of the panel cover of the embodiment of FIG. 1.
Figure 4:
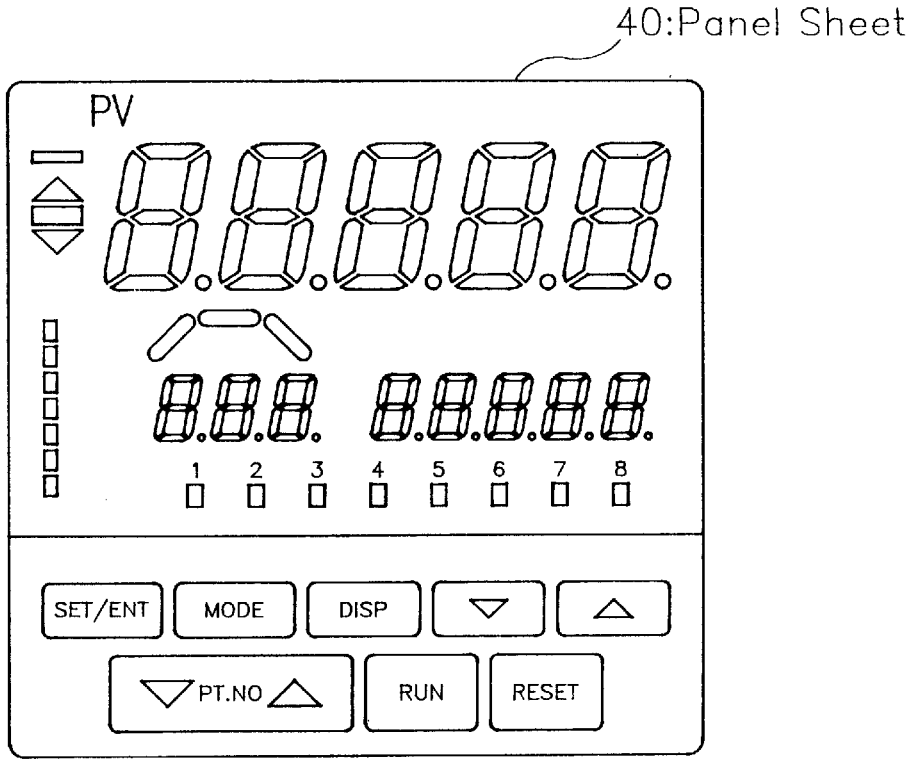
FIG. 4 is a front view depicting a panel sheet.

FIGS. 2 and 3 show details of parts of the embodiment of FIG. 1, wherein FIG. 2 is a perspective view and FIG. 3 is a cross sectional view. In FIGS. 2 and 3, light emitting diodes ("LED") 21 and switch 22 are mounted on display card 20, which is mounted on the rear of panel cover 30 so that the front face thereof is opposite the rear face of panel cover 30 and fixed with latch 30*a*. Panel cover 30 is provided with reflecting holes 31 which are arranged in locations corresponding to the LEDs 21 on display card 20 and which guide light from the LEDs 21. Panel cover 30 also forms keys 32 in positions corresponding to switches 22 on card 20 and also forms resilient links 33 connected to keys, respectively. Panel sheet 40 is adhered to the front face of panel cover 30. An example of the panel sheet 40 is shown in FIG. 4. However, the panel sheet 40 shown in FIG. 4, which is one actually used in the product, does not correspond exactly to the panel cover 30 in FIGS. 2 or 3.

The apparatus is assembled as follows: LEDs 21 and switches 22 are mounted on display card 20 (note that we interchangibly use "display card" for "printed circuit board"). Display card 20 is attached to the rear face of panel cover 30. Thus, display card 20 is fixed to panel cover 30 with latch 30*a*. Finally, panel sheet 40 is adhered to the front surface of panel cover 30.

Figure 5:
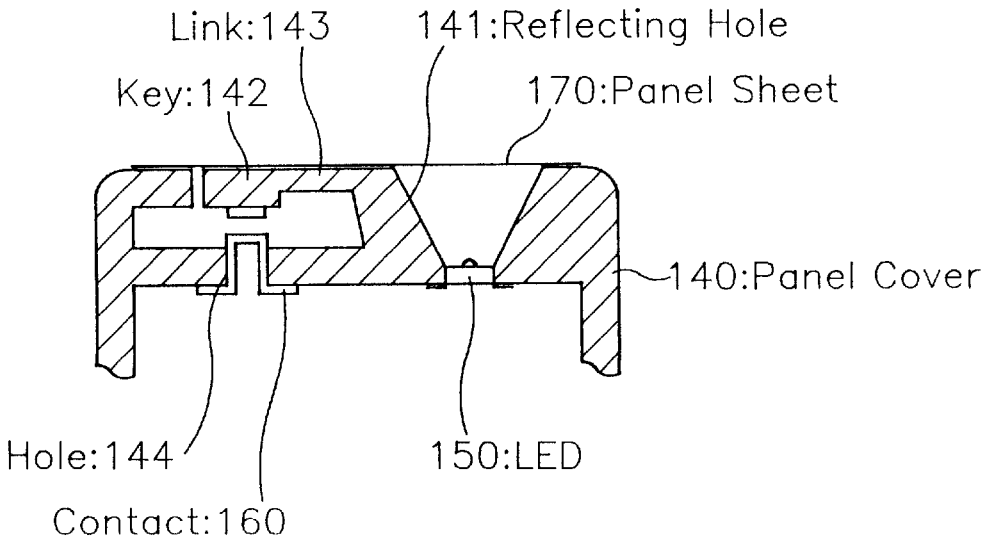
FIG. 5 is a cross sectional view depicting details of the panel cover of an illustrative second embodiment of the invention.

Next, a second illustrative embodiment is shown in FIG. 5 and comprises panel cover 140 provided with reflecting holes 141 which guide light from the rear to the front and forms keys 142 together with resilient links 143 connected to the keys 142, respectively, and also forms connecting circuits (not shown). Panel cover 140 has holes 144 in positions corresponding to keys 142, respectively. LEDs 150 are mounted from the rear in positions corresponding to the reflecting holes 141. Contacts 160 are attached to holes 144, respectively, from the rear of panel cover 140 and act as contacts when corresponding keys 142 are pressed. Panel sheet 170 is adhered to the front face of panel cover 140. Connecting circuits are formed on panel cover 140 for the same purpose as those of the connecting circuits on display card 20 of FIGS. 2 and 3.

The embodiment of FIG. 5 is assembled as follows: LEDs 150 and contacts 160 are mounted on reflecting holes 141 and holes 144, respectively, from the rear of panel cover 140. Panel sheet 170 is then adhered to the front face of panel cover 140.

The foregoing embodiments and components thereof have the following effects and advantages:

(1) Since the reflecting holes 31 of FIGS. 1,2,3 (shown as 141 in FIG. 5) [the same type of designation is applied hereinafter], keys 32 (142), links 33 (143) are formed on panel cover 30 (140), the time required to mount spacers and the like and keys as separate elements is eliminated. Also, the time required to mount the parts on the display card 20 of FIGS. 1,2,3, is reduced.

(2) Conventional LED modules usually have unutilized space at positions other than where the display symbols are located. In the invention, the reflecting holes 31 (141)are formed through panel cover 30 (140), so that under-utilized space is eliminated and so that consequently,the display symbols can be enlarged for same sized panel as compared to the prior art. This increases considerably the visibility of the display.

(3) Since spaces can be provided around the LEDs 21 (150), because light is guided from the LEDs 21(150) through reflecting holes 31 (141) of panel cover 30 (140), temperature increase of the LEDs 21 (150) can be prevented. This enables the service life of the LEDs 21(150) to be increased considerably.

The invention is not limited to the foregoing range; e.g., although the resilience of the links is the same in the foregoing description, the operating force may be changed for each switch by changing the resiliency by varying the width of the links. In such configuration, since the switches cannot be easily pressed by increasing the resiliency of the links, such as for an emergency stop switch, misoperation can be easily prevented.

Also, advantageously, contact 160 of FIG. 5 may be of any material at the contact part, or may be of a pattern provided on the keys or the panel cover. Moreover, the reflecting holes of FIG. 2, may be provided separately from the panel cover. For example, the configurations shown in FIGS. 6 and 7 may be used.

Figure 6:
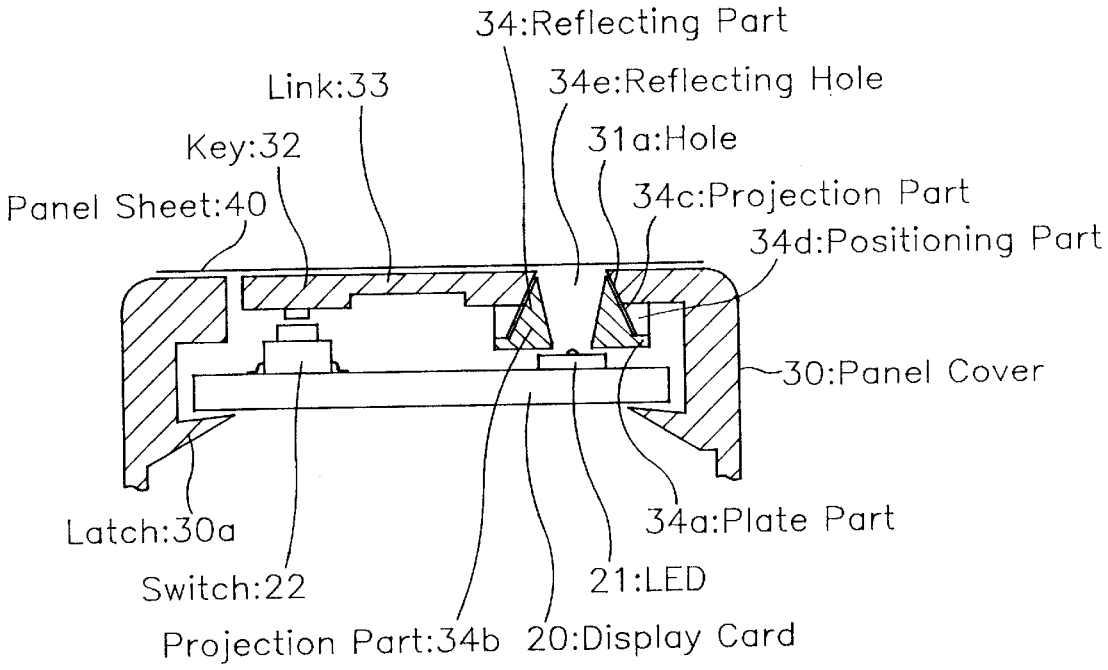
FIG. 6 is a cross sectional view depicting details of the panel cover of an illustrative third embodiment of the invention.
Figure 7:
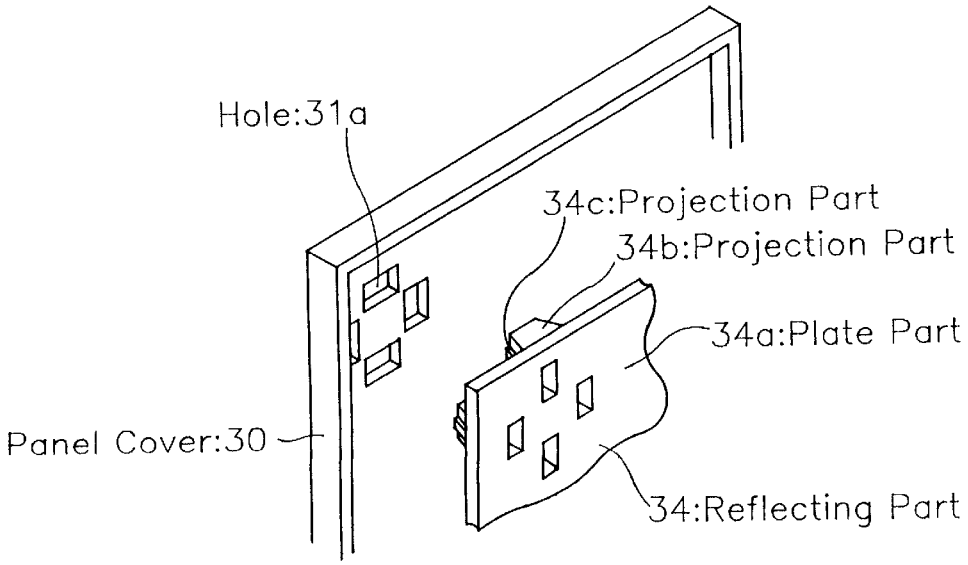
FIG. 7 is a view depicting assembly of the instrument of FIG. 6.

In FIGS. 6 and 7,holes 31*a* are provided through panel cover 30 at locations opposite to LEDs 21. Reflecting part 34 comprises plate part 34*a,* projection parts 34*b,* projection parts 34*c,* and positioning parts 34*d.* Projection parts 34*b* are attached to plate part 34*a,* have reflecting holes 34*e* to guide light from LEDs 21 to the front of panel cover 30, and are inserted into holes 31*a*. Projection parts 34*c* are provided on projection parts 34*b* along the direction of penetration. Positioning parts 34*d* determine the position of reflecting part 34 to panel cover 30. The positioning parts 34*d* are not shown in FIG. 7 for sake of clarity.

The embodiment of FIG. 6 is assembled as follows, with reference to FIG. 7. Projection parts 34*b* of reflecting part 34 are inserted into holes 31*a*. Each projection part 34*c* is deformed as it is inserted into each hole 31*a* and, hence, reflecting part 34 is fixed to holes 31*a*. Other assembly procedures are omitted since they are similar to those for the embodiment of FIG. 2.

If the reflecting holes 31*a* are made to be separable, as described above, the color of panel cover 30 can be selected in a manner different from the color of the holes. In other words, even if the color of panel cover 30 is selected to be of a certain color, for example, to be a color whose reflectance of light is low, such as black, the display does not become illegible or unreadable by selecting the color of the reflecting part 34 to be of a color whose reflectance is high, such as white, because it does not reduce the reflectance of light from the LEDs 21. Also, if the reflecting part 34 is made, for example of NORYL (trademark of a material of modified polyphenylene oxide), the shielding effect of light is enhanced.

Panel Sheet

Figure 8:
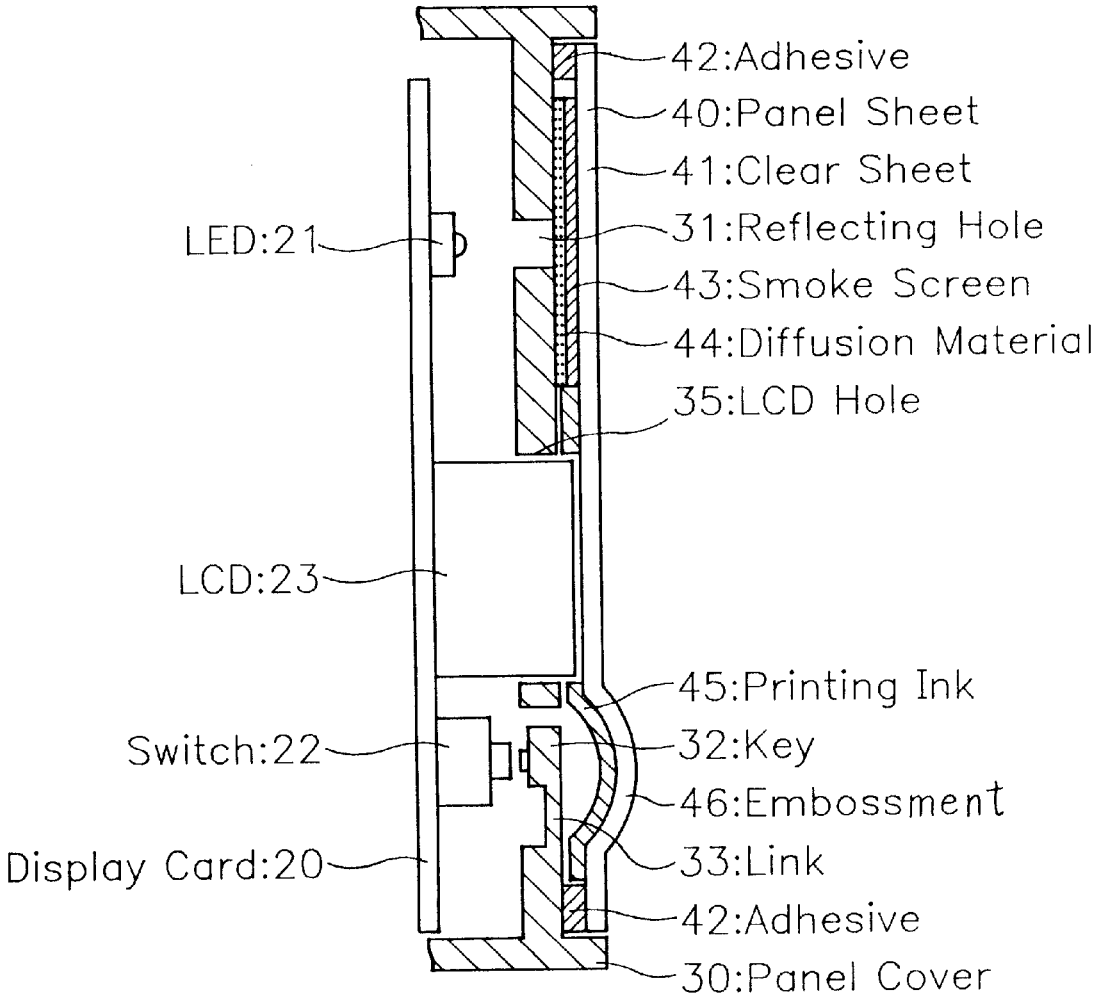
FIG. 8 is a view depicting details of a part of the embodiment of FIG. 1.

In FIG. 8 a display card 20 has incorporated therein LEDs 21, switches 22 and liquid crystal display (LCD) 23. Display card 20 is mounted on the rear of panel cover 30 so that the front face of display card 20 is opposite the rear face of panel cover 30 which has reflecting holes 31, keys 32, links 33 and LCD hole 35. Reflecting holes 31 are formed at locations where the light from LEDs 21 are guided therethrough from the rear to the front. Keys 32 are formed at locations opposite switches 22. Links 33 are resilient and form links with keys 32. LCD hole 35 is formed at a position where the display face of LCD 23 is guided to the front face of panel cover 30.

Panel sheet 40 is made, for example, of a clear sheet 41 and is adhered to the front face of panel cover 30 with an adhesive 42 with the front face of panel cover 30 opposite the rear face of clear sheet 41. A smoke screen 43 is printed on the rear face of clear sheet 41 at a position opposite LEDs 21, and transmits light from the LEDs 21 while shielding the shape surrounding LEDs 21 from outside of the panel. A diffusion material 44, for example, of $TiO_2$, is printed on smoke screen 43 and acts to diffuse light from the LEDs 21. Printing ink 45 prints the desired symbols on the rear face of clear sheet 41. An embossment 46 is provided in a position opposite keys 32.

Figure 9:
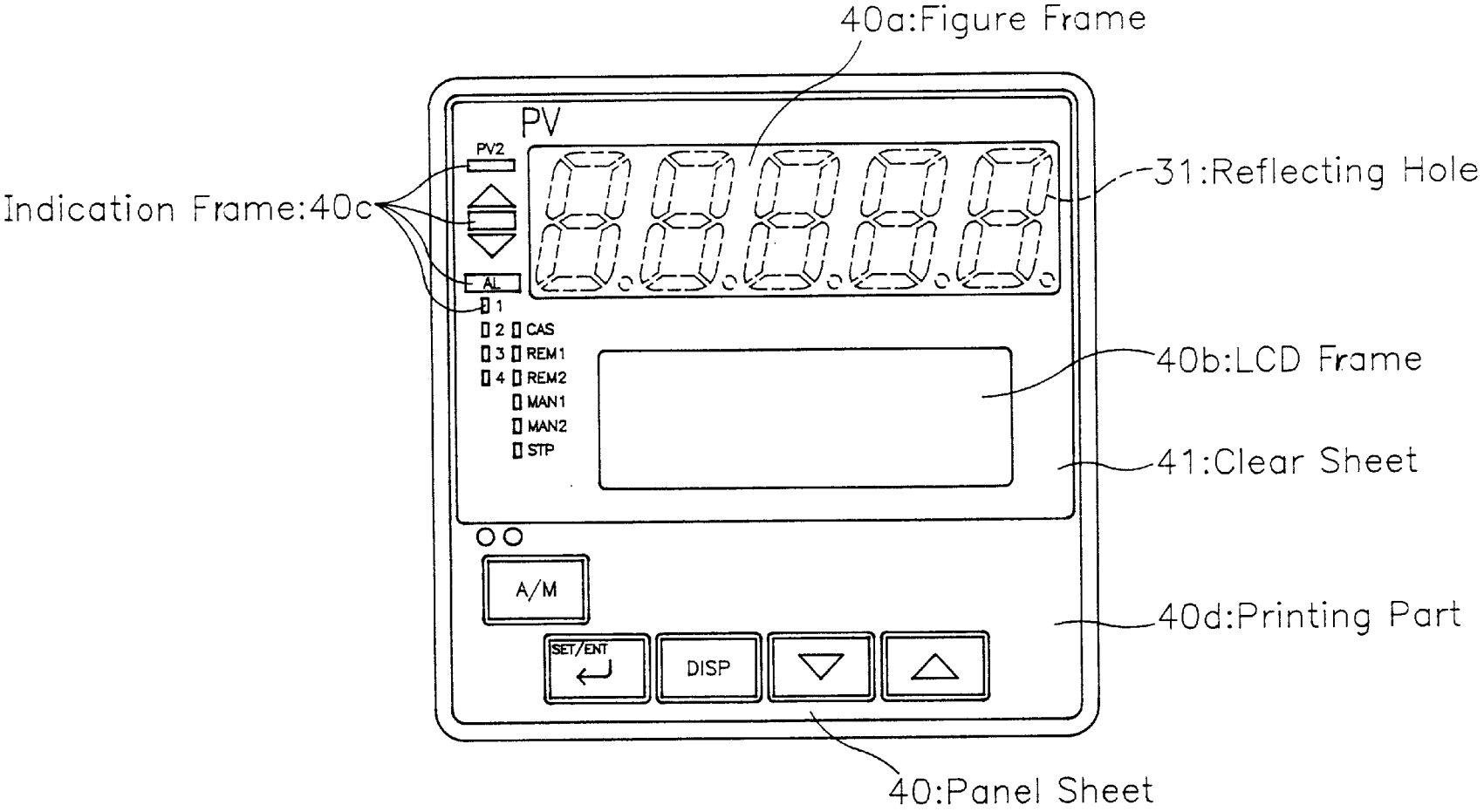
FIG. 9 is a view depicting a panel sheet.

FIG. 9 shows an actual panel sheet 40, wherein the broken lines indicate the contours of the reflecting holes 31. The figure frame 40*a* comprises smoke screen 43 and diffusion material 44 printed on the rear face of clear sheet 41. LCD frame 40*b* is an area of the display where none of the printing is applied to the clear sheet 41 and so the display of LCD 23 can be read. For indication frame 40*c,* only diffusion material 44 is printed on the rear face of clear sheet 41. For printing part 40*d,* operation and action symbols are printed on the rear face of sheet 41 and suitable embossment is provided.

Manufacturing and operation of the FIG. 9 embodiment will now be described with reference to FIG. 8. Smoke screen 43 and diffusion material 44 are printed on the rear face of sheet 41 at positions opposite LEDs 21. Printing ink 45 is printed on the rear face of sheet 41, that is, operational and action symbol are printed. Then, embosssment 46 is formed on panel sheet 40. Panel sheet 40 is adhered to panel cover 30 with adhesive 42, and then, display card 20 is mounted on panel cover 30.

Since diffusion material 44 is printed on sheet 41,advantageously, a separate diffusion sheet is not needed. This reduces assembly time and decreases the number of components needed in the embodiment. Also, the indication produced by the LCD can be clearly read because this part can be formed using the clear sheet 41 without any other sheets used therewith. The invention, however, is not limited to the the configurations above described. For example, the smoke screen 43 and diffusion material 44 can be mixed and then printed on panel sheet 40. Moreover, although the LCD is incorporated in the embodiment, such is not necessary and no LCD need be used.

Packing

Figure 10:
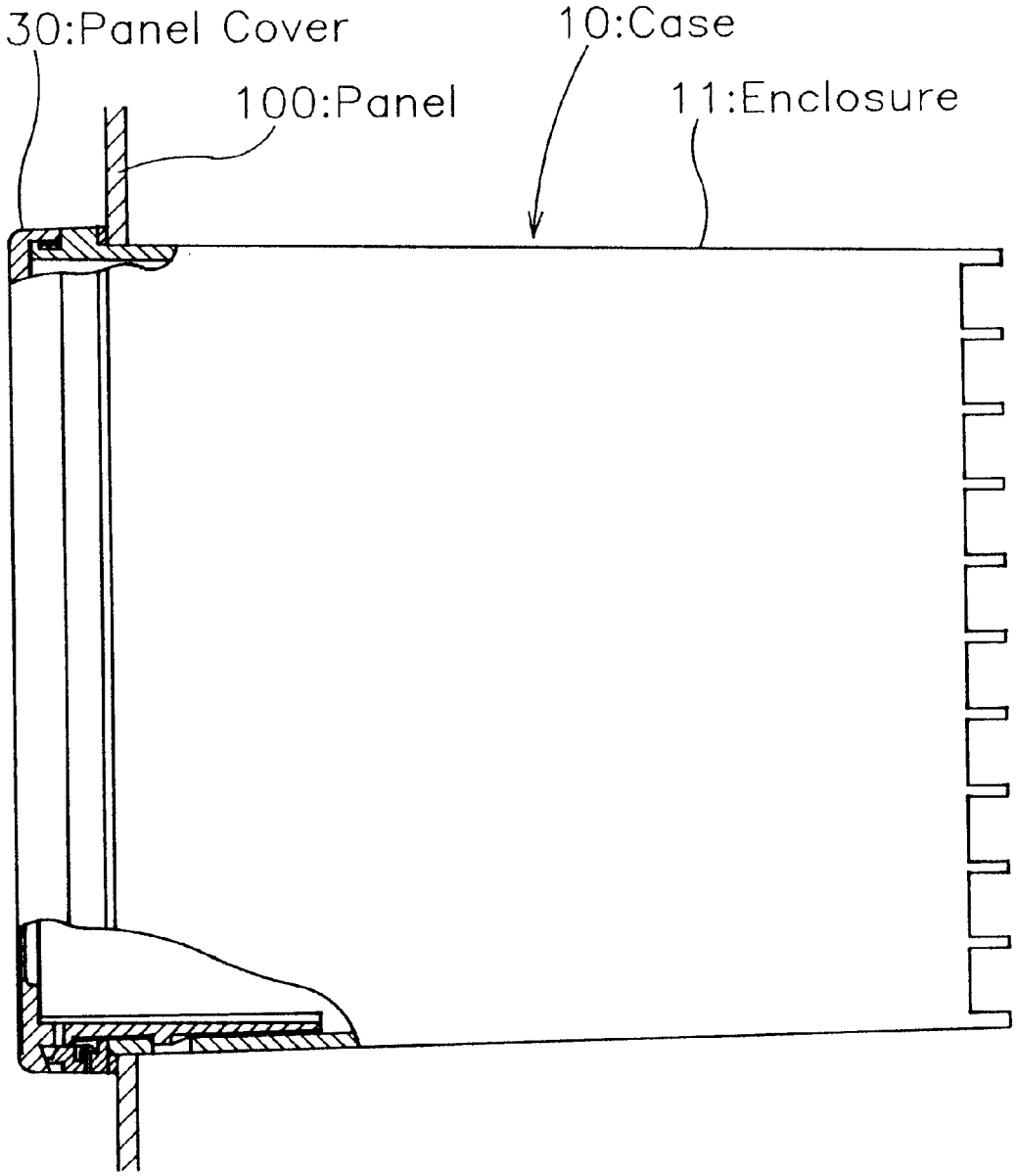
FIG. 10 is a side view depicting the embodiment of FIG. 1.
Figure 11:
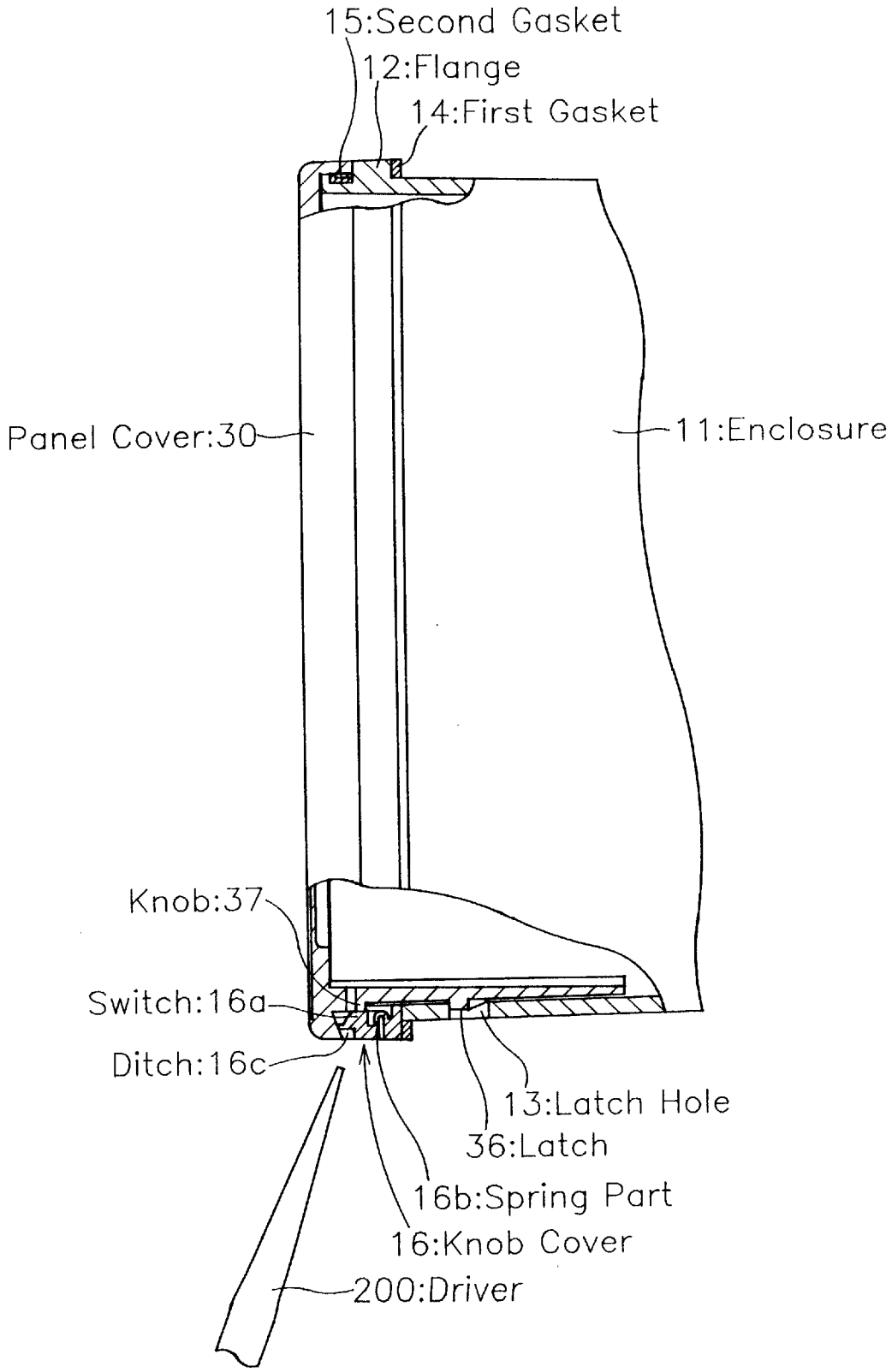
FIG. 11 is a view depicting an enlarged part of the instrument of FIG. 10.

FIGS. 10 and 11 show a part of the embodiment of FIG. 1, wherein FIG. 10 is a side view and FIG.11 is an enlarged view of the part comprising a case 10 of a panel instrument, formed in the shape of a barrel, accommodating circuit boards inside and having terminal boards to which crimp-on terminal lugs, or the like, are connected in the rear,and mounted on panel 100. A panel cover 30 having switches and displays thereon is mounted on an open end of case 10. The panel cover 30 also has latch 36 and knob 37 which is used to move latch 36 when pushed.

Case 10 comprises and enclosure 11 made of plastic and having flange 12 provided at its circumference and latch hole 13 into which latch 36 is inserted. A first gasket 14, made of an elastomer, is formed integrally with enclosure 11 by a two color molding and is provided between flange 12 and panel 100. A second gasket 15 made of an elastomer is formed integrally with enclosure 11 by a two color molding and is provided between enclosure 11 and panel cover 30 and having knob cover 16 that covers knob 37. Second gasket 15 is coupled to first gasket 14 at knob cover 16.

Figure 12:
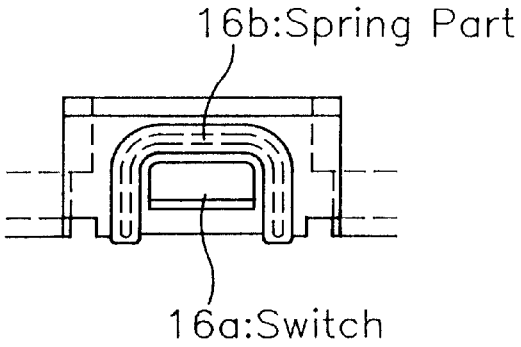
FIGS. 12(*a*)–12(*c*) are enlarged views depicting a knob cover.
Figure 12:
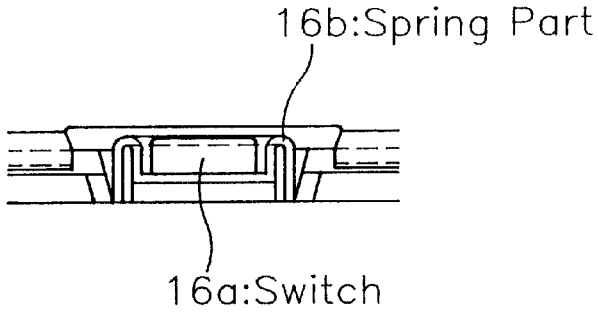
Figure 12:
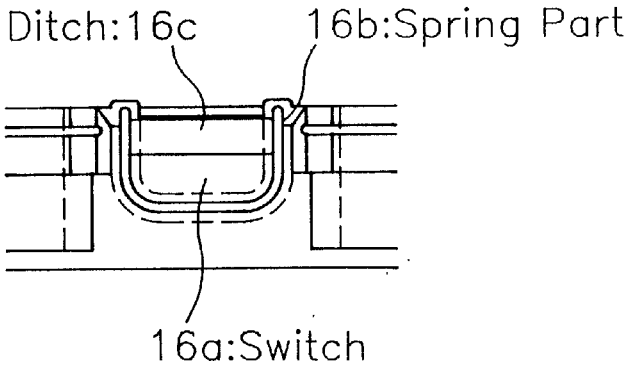

Knob cover 16 has switch 16*a* and spring part 16*b* as shown in FIGS. 12(*a*)–13(*c*), wherein FIG. 12(*a*) is a plan view, FIG. 12(*b*) is a front view, and FIG. 12(*c*) is a bottom view. Switch 16*a* forms channel 16*c,*into which a tool 200, e.g. a screwdriver, is inserted, together with panel cover 30. Knob 37 is pressed by screwdriver 200 and spring part 16*b* is coupled to switch 16*a* and first gasket 14 which is deformed resiliently when switch 16*a* is pressed.

Figure 13:
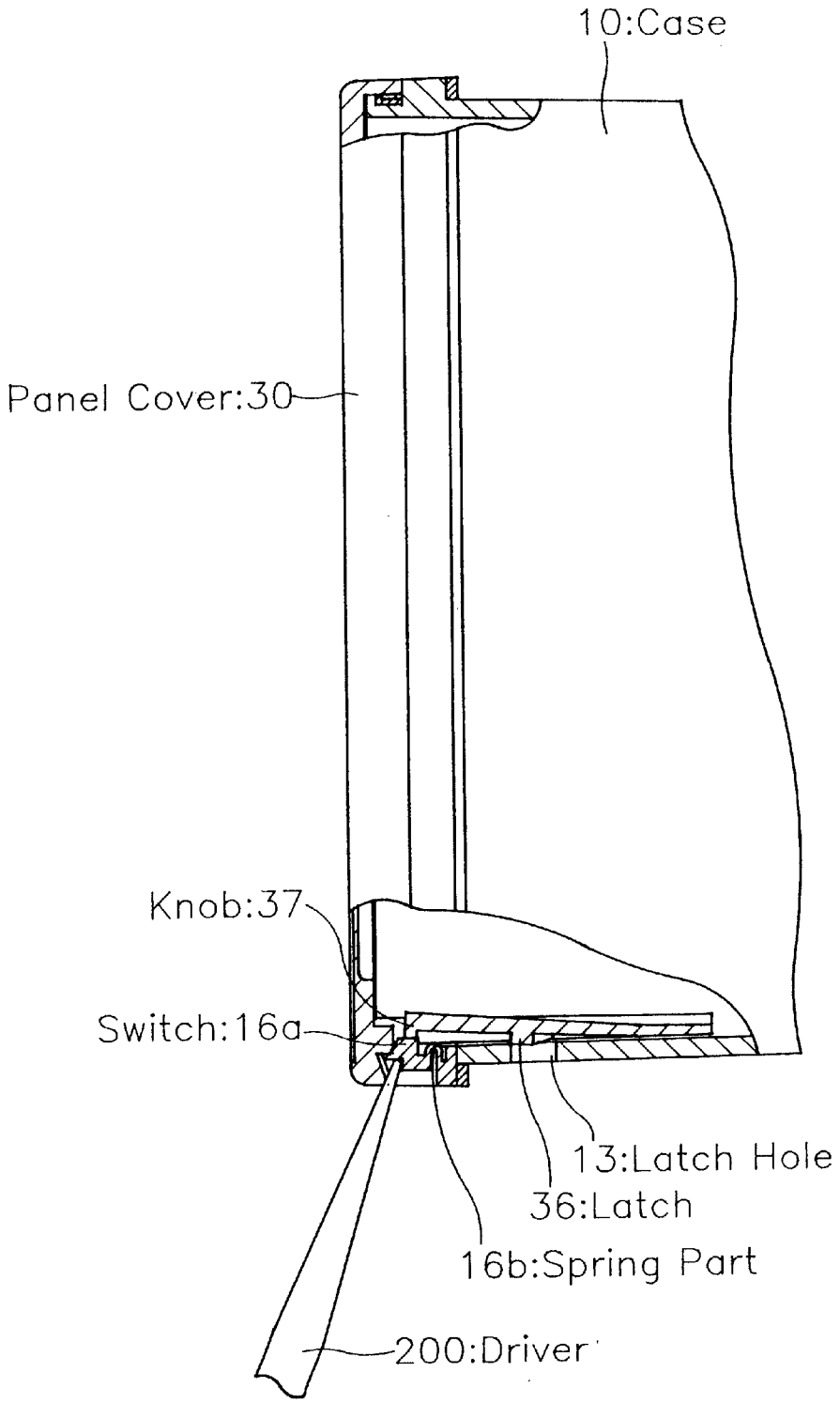
FIG. 13 is a view depicting removal of the case and panel cover.
Figure 14:
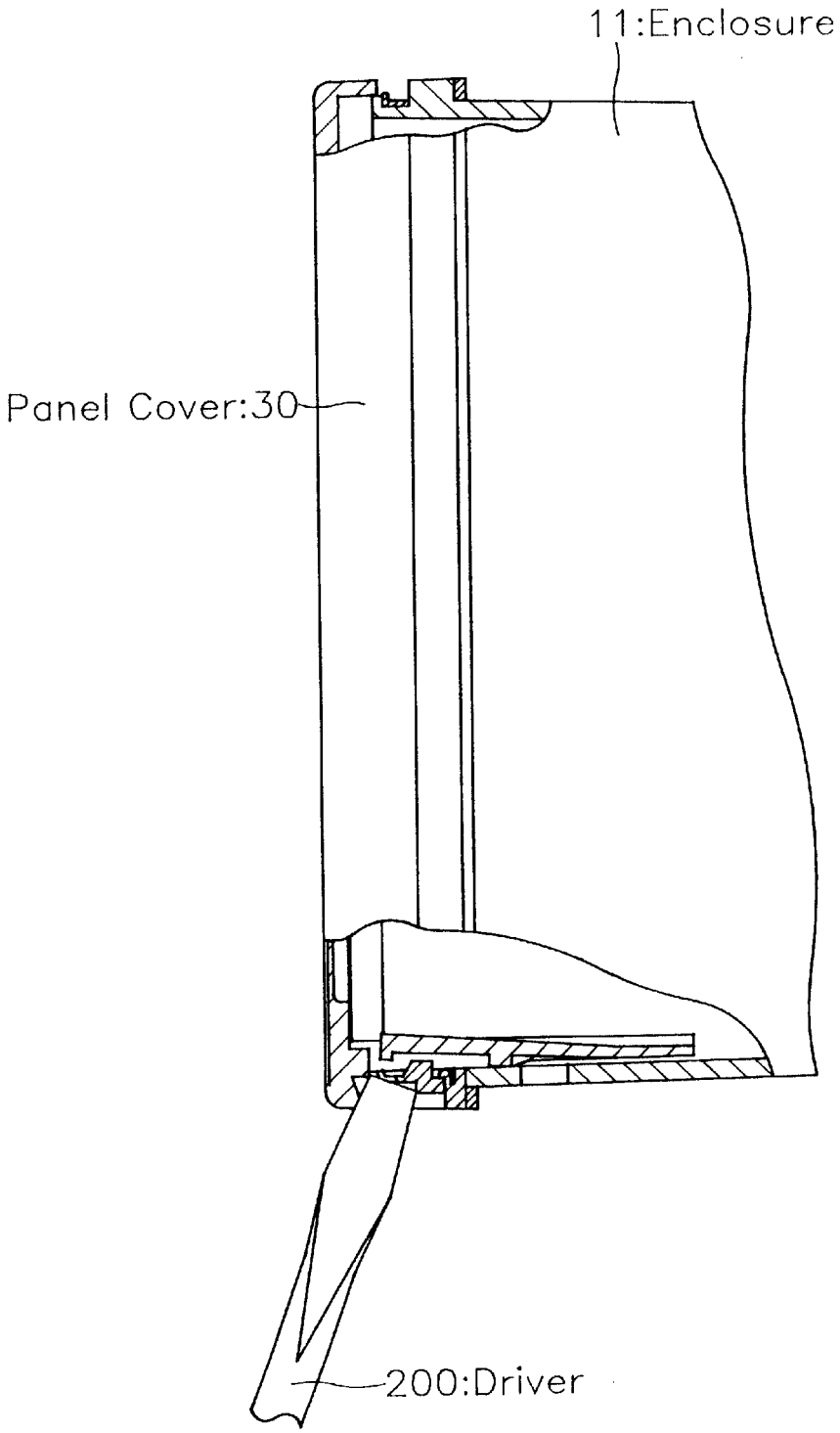
FIG. 14 is a view depicting the removal of the case and panel cover.

The operation of the part is described in connection with FIGS. 13 and 14 which illustrate the removal of case 10 and panel cover 30. When screwdriver 200 is inserted into channel 16*c* and pushes switch 16*a,* spring part 16*b* is deformed and at the same time knob 37 is pressed and latch 36 is disengaged from latch hole 13 (see FIG. 13). When screwdriver 200 is turned, panel cover 30 is disengaged from enclosure 11 (see FIG. 14).

When panel cover 30 is to be engaged with enclosure 11, panel cover 30 is disposed in enclosure 11 and then latch 36 is moved. When panel cover 30 is further inserted, latch 36 falls into latch hole 13 and panel cover 30 is engaged with enclosure 11.

For mounting case 10 to panel 100, case 10 is inserted into a hole cut from the front of panel 100 and first gasket 14 is disposed between case 10 and panel 100 to provide waterproof and dustproof properties.

Since first gasket 14 and second gasket 15 are formed integral with enclosure 11 by a two color molding process, mounting of the gaskets is not necessary. Also, since the gaskets are molded integrally with enclosure 11, the gaskets cannot come off,hence, the gaskets provide waterproof and dustproof properties to the arrangement.

With this embodiment, since switch 16*a,* spring part 16*b,* and channel 16*c* can be used to separate panel cover 30 from case 10 by use of a tool, such as screwdriver 200, the waterproof and dustproof properties are readily maintained, and reduction of size combined with maintenance of such properties is enhanced.

Terminal Board (A)

Figure 15:
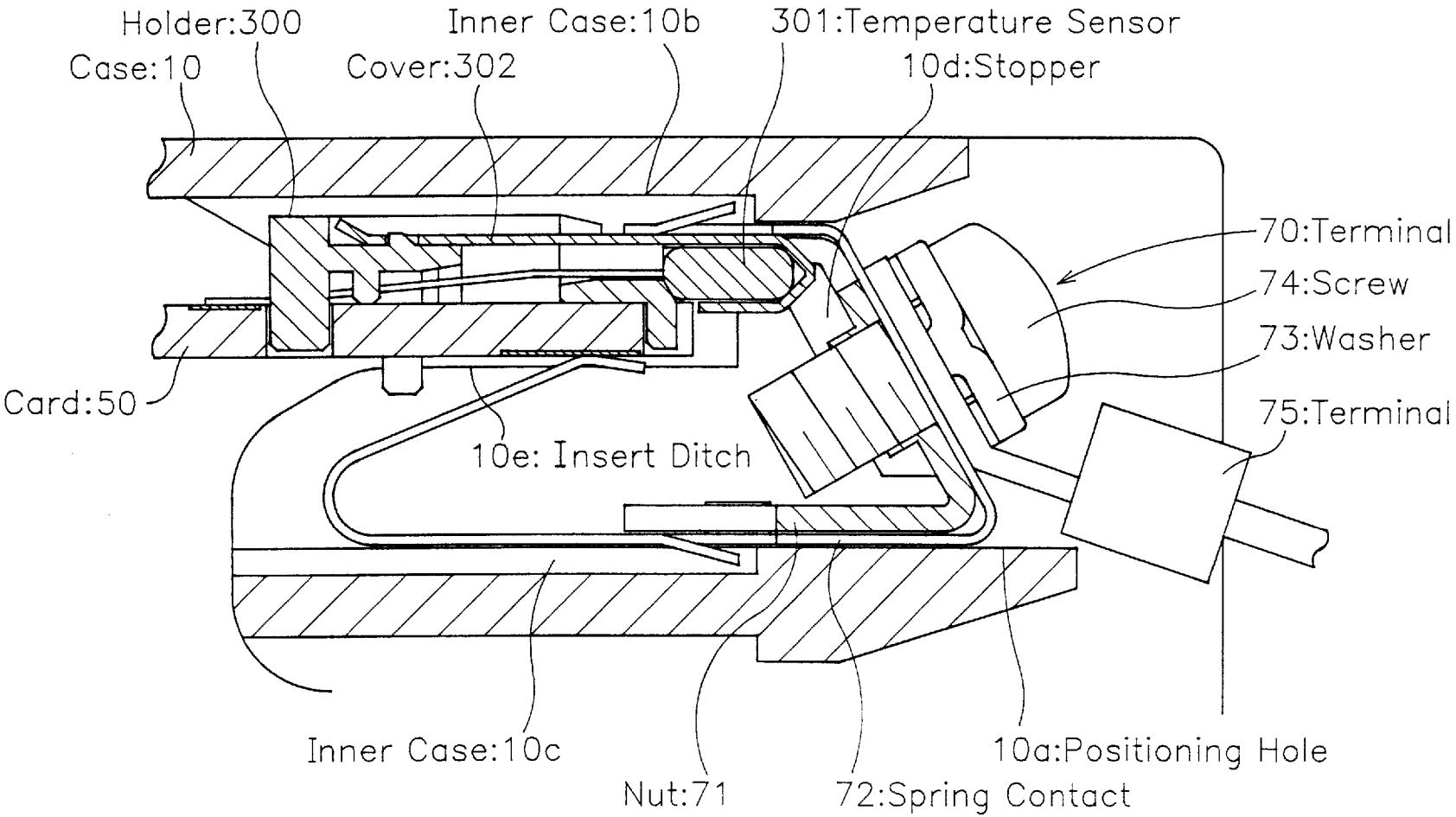
FIG. 15 is a cross sectional view depicting details of a part of the embodiment of FIG. 1.

FIG. 15 shows the terminals of the embodiment of FIG. 1, wherein more than one positioning hole 10*a* is provided through case 10, and opposite inner cases 10*b* and 10*c,* stopper 10*d,* and insert channel 10*e* are located in each positioning hole 10*a*. Terminal 70 comprises a nut 71, spring contact 72, washer 73, and screw 74, and is connected with terminal 75 (which may be a crimp-on lug). Terminal 70 is retained by stopper 10*d* when inserted into positioning hole 10*a*.

Figure 16:
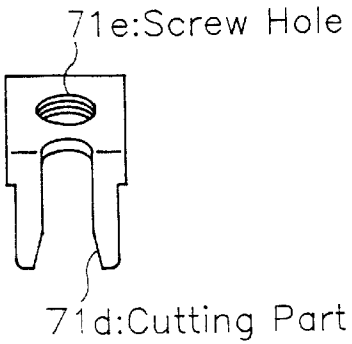
FIGS. 16(*a*)–16(*c*) are views depicting details of the nut.
Figure 16:
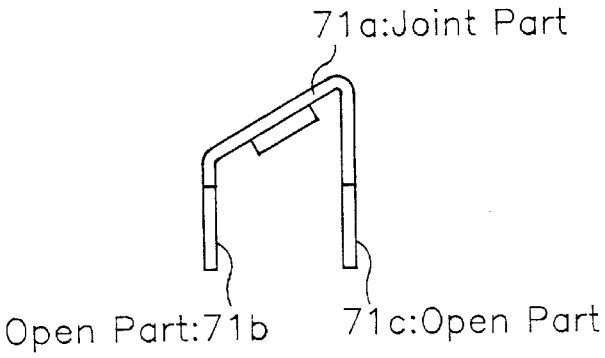
Figure 16:
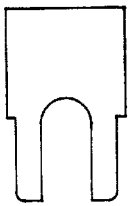
Figure 19:
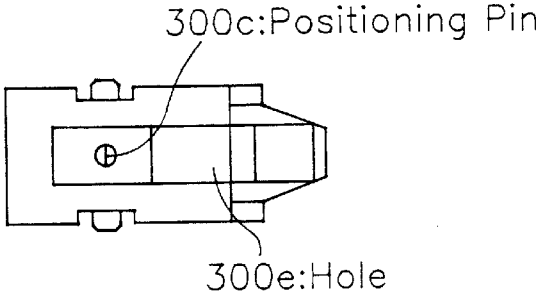
FIGS. 19(*a*)–19(*e*) are views depicting details of the holder.
Figure 19:
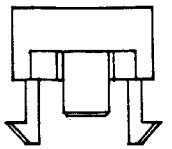
Figure 19:
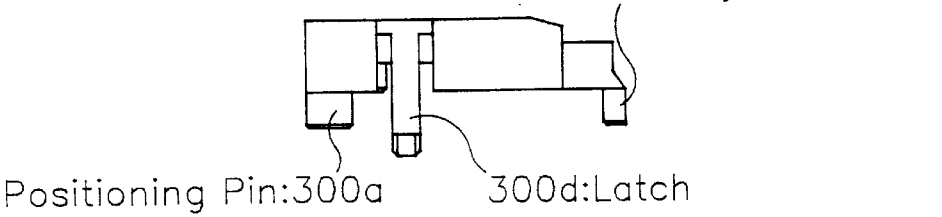
Figure 19:
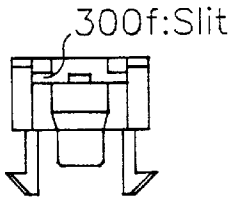
Figure 19:
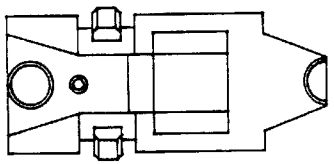

Nut 71 is formed of an approximate horseshoe shape and is of a thick plate material and comprises joint part 71*a* and open parts 17*b* and 71*c* at both ends as shown in FIGS. 19(*a*)–16(*c*), wherein FIG. 16(*a*) is a left side view, FIG. 16(*b*) is a front view, and FIG.16(*c*) is a right side view. Cutting part 71*d* is formed in an open part 71*b* toward joint part 71*a*. Screw hole 71*e* is provided in joint part 71*a*.

Figure 17:
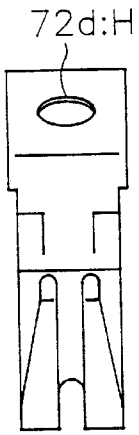
FIGS. 17(*a*)–17(*c*) are views depicting details of the spring contact.
Figure 17:
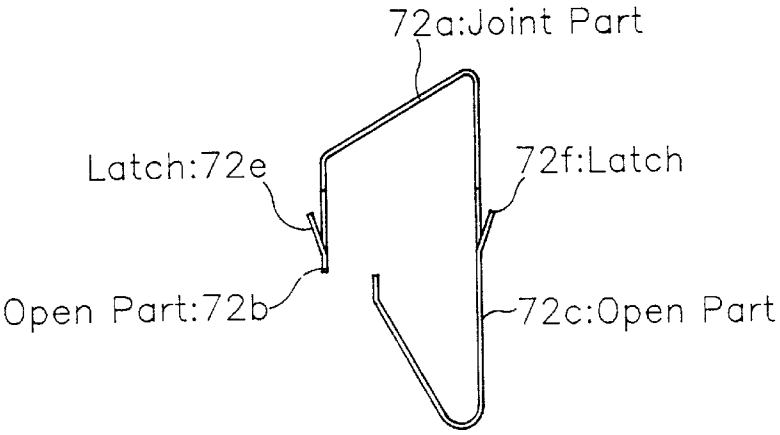
Figure 17:
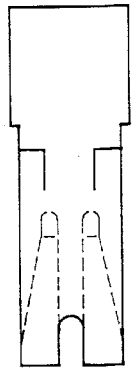

Spring contact 72, of FIG. 15, for example, is formed of an approximate horseshoe shape with a copper spring sheet and has inserted therein nut 71. The spring contact 72 comprises a joint part 72*a* with open parts 72*b* and 72*c* at both ends as shown in FIGS. 17(*a*)–17(*c*), wherein FIG. 17(*a*) is a left side view, FIG. 17(*b*) is a front view, and FIG. 17(*c*) is a right side view. Joint part 72*a* is provided with a hole 72*d* through which screw 74 is disposed. Open parts 72*b* and 72*c* have latches 72*e* and 72*f,* respectively. Latches 72*e* and 72*f* are inserted into inner case 10*b* and 10*c,* respectively and prevent terminal 70 from coming off the positioning hole 10*a*. Open part 72*c* is bent into an approximate U-shape inside the horseshoe shaped spring contact 72 and its free end is further formed to be bent inwardly, as shown in FIG. 17(*b*).

Figure 18:
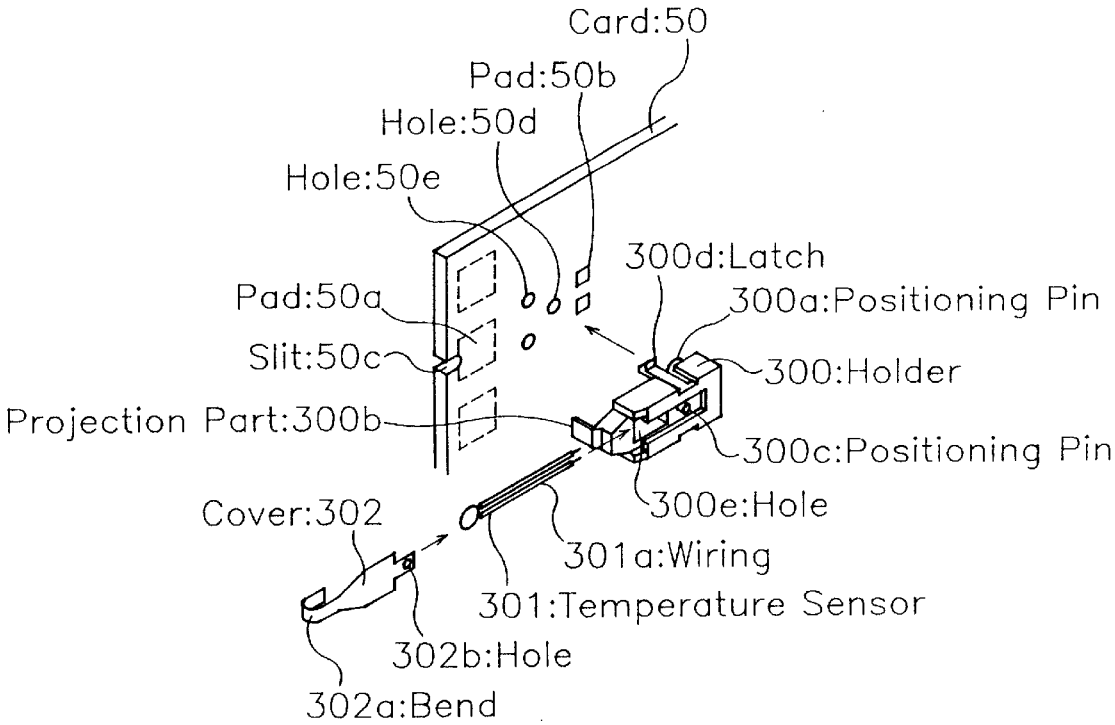
FIG. 18 is a view depicting assembly of the card and holder.

Returning to FIG. 15, card 50 is accommodated in case 10 and guided toward terminal 70 by insert channel 10*e* and, as shown in FIG. 18, has pads 50*a* and 50*b* for connection to mounted circuits (not shown), slits 50*c,*and holes 50*d* and 50*e*. Pad 50*a* is electrically connected to open part 72*c* of spring contact 72.

Holder 300 is formed of a heat insulating material, such as polyphenylene sulfide, and holds temperature sensor 301 and comprises positioning pin 300*a,* projection part 300*b,* positioning pin 300*c,* latch 300*d,* hole 300*e,*and slit 300*f,* as shown in FIGS. 19(*a*)–19(*e*), wherein FIG. 19(*a*) is a plan view, FIG. 19(*b*) is a left side view, FIG. 19(*c*) is a front view, FIG. 19(*d*) is a right side view, and FIG. 19(*e*) is a bottom view. Positioning pin 300*a* and projection part 300*b* are inserted into hole 50*d* and slit 50*c,* respectively, to thereby position holder 300 onto card 50 (see FIG. 20). Latch 300*d* is inserted into hole 50*e* to fix holder 300 to card 50. Hole 300*e* guides wiring 301*a* of temperature sensor 301 from the top to the bottom.

Cover 302 (see FIG. 18) is formed of a heat conductive material, such as copper, and holds sensor 301 by covering the sensor with bend 302*a* formed by bending, and is inserted into slit 300*f* (see FIG. 19(*d*)) of holder 300 and then is fixed by positioning pin 300*c* into hole 302*b*. Cover 302 is guided by cutting part 71*d* of nut 71 (see FIGS. 15 and 16(*a*)) to be thermally connected to open part 72*b* (see FIG. 17(*b*)) of spring contact 72.

The assembly of the device is now described with reference to FIG. 18, wherein wiring 301*a* of sensor 301 is inserted into hole 300*e* of holder 300 and guided from the top to the bottom of holder 300. Cover 302 is inserted into slit 300*f* of holder 300 and positioning pin 300*c* is inserted into hole 302*b*. This fixes cover 302 to holder 300, and sensor 301 is fixed to holder 300. Sensor 301 is then fixed to cover 302 using silicone or the like. Positioning pin 300*a,* projection part 300*b,* and latch 300*d* are inserted into hole 50*d,* slit 50*c* and hole 50*e* of card 50, respectively. This allows latch 300*d* to fit into card 50, and holder 300 is fixed to card 50.

Figure 20:
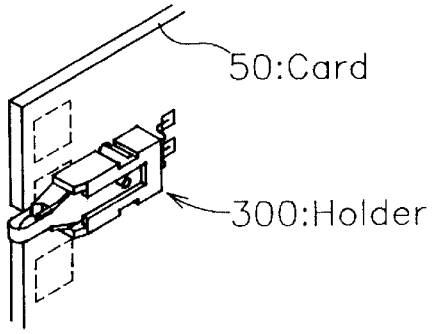
FIG. 20 is a view depicting the card and the holder as assembled.

Wiring 301*a* of temperature sensor 301 is soldered to pad 50*b* of card 50. The completely assembly of holder 300 and card 50 is as shown in FIG. 20. Next, to complete the assembly shown in FIG. 5, card 50 is inserted along insert channel 10*e* from left to right in FIG. 15. This electrically connects pad 50*a* of card 50 with open part 72*c* of spring contact 72 and thermally connects cover 302 with open part 72*b* of spring contact 72 as guided by cutting part 71*d*. Then, the heat of terminal 70 is conducted to sensor 301 through cover 302. The thermocouple output can be compensated for temperature by using the temperature measured by sensor 301.

Since sensor 301 is heat insulated from card 50 by cover 302, the terminal temperature can be measured without being affected by the temperature of the card 50, and the thermocouple output can be accurately compensated for the terminal temperature. Also, since sensor 301 is fixed with holder 300 and cover 302, the combined unit can be attached to card 50 as one part, which facilitates assembly. Also, advantageously, since sensor 301 is provided in the space used for the mounting terminal 70,terminals can be provided effectively without impeding reduction of size.

Figure 21:
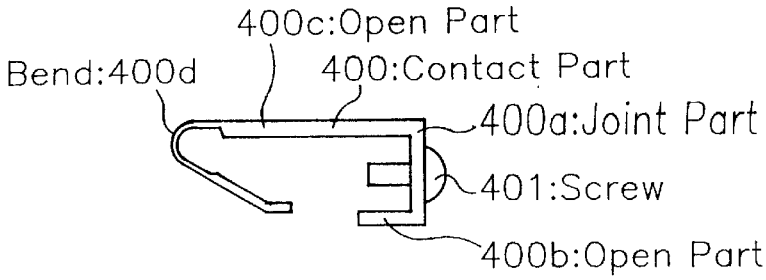
FIG. 21 is a view depicting another example of a terminal.

Although the embodiment comprises a nut 71 and spring contact 72, the invention is not limited to such an arrangement. As shown in FIG. 21, the nut and spring arrangement may be made of one part. That is, the contact part 400 is formed of an approximate horseshoe shape with a thick plate and comprises joint part 400*a* and open parts 400*b* and 400*c* at the ends thereof. Joint part 400*a* is provided with a screw hole in which screw 401 is disposed. Open part 400*c* is bent into an approximate U-shape inside the horseshoe shaped portion with bend 400*d* bent after being thinned by forging and the free end bent further inwardly. This provides the spring force required to contact the pad on the card 50.

Terminal Board (B)

Figure 22:
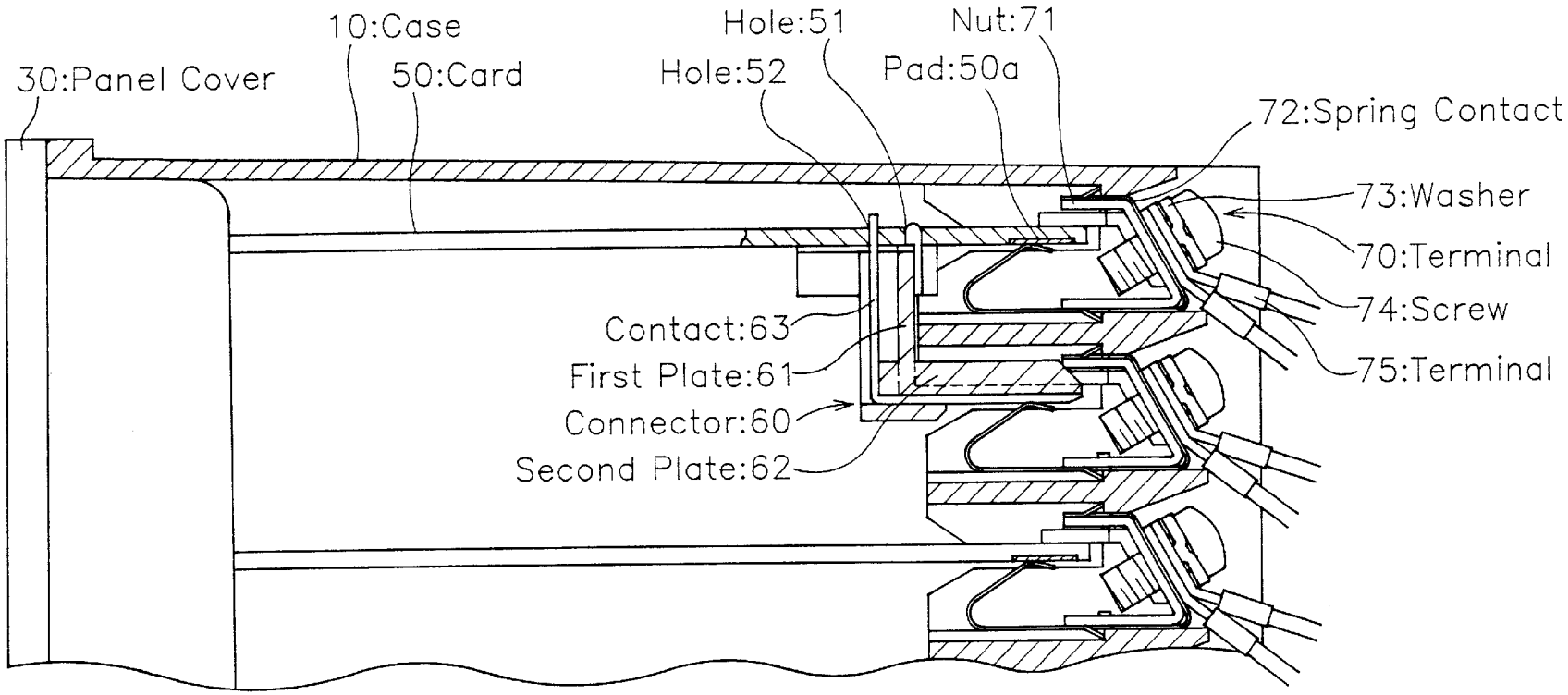
FIG. 22 is a cross sectional view depicting details of the embodiment of FIG. 1.

FIG. 22 shows case 10 formed in the shape of a barrel. Panel cover 30 is attached to an open end of case 10 and has displays and switches thereon. Terminals 70 are provided at the rear of case 10 with terminals 75, which may be crimp-on type lugs, attached thereto. Card 50 may have electronic components (not shown)mounted thereon, and is attached perpendicularly to panel cover 30, with a card edge connector or pad 50*a* formed thereon, electrically connected to terminals 70, and holes 51 and 52. Connector 60 is attached to card 50 and electrically connects card 50 to terminals 70.

At terminal 70, nut 71 is formed of an approximate horseshoe shape and has a screw hole. Spring contact 72 is formed of an approximate horseshoe shape with a hoel and one end bent into a horeshoe shape, and acts to contact pad 50*a* of card 50 as well as hold nut 71 thereunder. Screw 73, with washer 74, fits into the screw hole of nut 71 through the hole of spring contact 72.

In connector 60, first plate 51 is made of an insulating material and is provided perpendicular to card 50. Second plate 62 is made of an insulating material and is provided perpendicular to one end of first plate 61. Contact 63 is made of an electrically conductive material and is formed at right angles and mounted along first plate 61 and second plate 62, and electrically connects terminal 70 to card 50.

Figure 23:
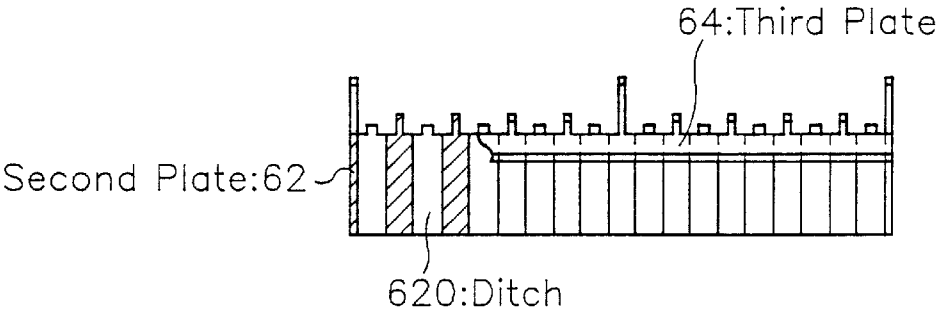
FIGS. 23(*a*)–23(*d*) are views depicting details of the first plate and the second plate.
Figure 23:
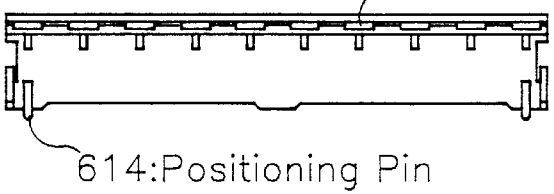
Figure 23:
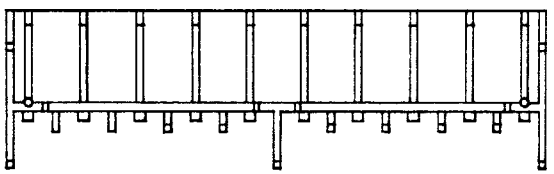
Figure 23:
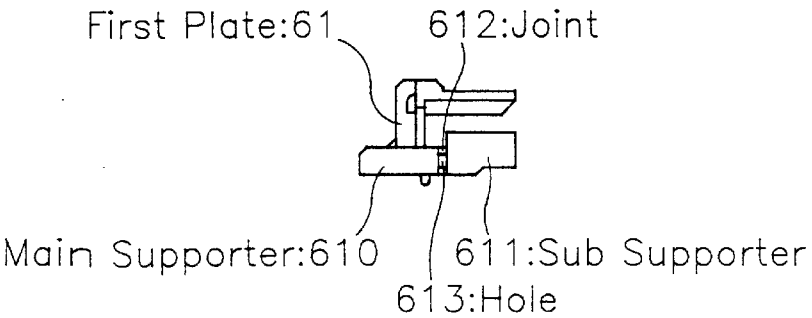
Figure 24:
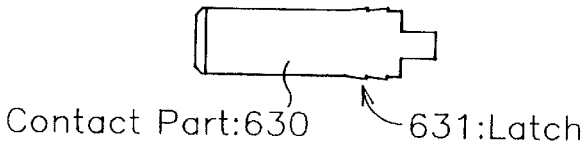
FIGS. 24(*a*)–24(*c*) are views depicting details of the contact.
Figure 24:
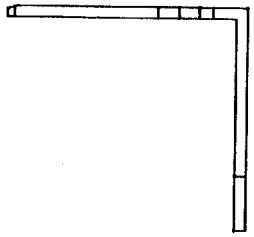
Figure 24:
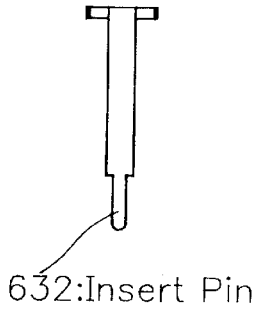

Details of the connector 60 are shown in FIGS.23(*a*)–23(*d*) and 24 (*a*)–24(*c*), wherein details of the first plate 61 and second plate 62 are shown in FIG. 23(*a*)–23(*d*), and details of the contact 63 are shown in FIGS. 24(*a*)–24(*c*), and wherein FIG. 23(*a*)is a plan view, FIG. 23(*b*) is a side view, FIG. 23(*c*) is a front view, and FIG. 23(*d*) is a bottom view, and wherein FIG. 24(*a*) is a plan view, FIG. 24(*b*) is a front view, and FIG. 24(*c*) is a side view.

In these figures, main supporter 610 is provided at the other end of first plate 61 and perpendicular thereto. Sub-supporter 611 is linked to main supporter 610 via joint 612. Joint 612 has a through hole 613 at its center. Positioning pin 614 is inserted into 51 of card 50. Channel 620 is provided in second plate 62 and contact 63 is fitted thereinto. Hole 621 comprises second plate 62 and third plate 64 and is guided to channel 620 through contact 63 and at the same time retains contact 63.

Contact part 630 is connected electrically to terminal 70. Latch 631 is provided on a side of contact part 630 to prevent it from coming out of hole 621. Insert pin 632 is inserted into hole 52 of card 50, soldered, and is electrically connected to card 50.

The device is assembled as follows. Contact 63 is press-fitted into hole 621. Press fitting is generally carried out automatically. Positioning pin 614 of connector 60 is inserted into hole 51 of card 50. At the same time, insert pin 632 is inserted into hole 52 of card 50. Connector 60 is mounted on card 50 with first plate 61 disposed perpendicular to card 50 by means of main supporter 610 and sub-supporter 611. Insert pin 632 is soldered to card 50. Sub-supporter is broken at joint 612 and removed from connector 60. Card 50 is mounted perpendicularly to panel cover 30 and together the two are inserted into the open end of case 10. This electrically connects terminal 70 to pad 50*a* of card 50 and electrically connects contact 63 to terminal 70.

Main supporter 610 prevents connector 60 from falling and thus prevents force from being applied to the soldered part of insert pin 632 by the reactive force to which connector 60 is subjected when connector 60 is inserted. This prevents poor contact from occurring between card 50 and insert pin 632. Card 50 can be connected to terminal 70 and still provide space for the first plate 61. Thus, since it is not necessary for card 50 to provide space for the connectors and studs, otherwise needed, advantageously, more electronic components can be mounted on card 50 of the instant invention.

Moreover, advantageously, since first plate 61 of connector 60 can be mounted perpendicular to card 50 by use of main supporter 610 and sub-supporter 611, connector 60 can be automatically mounted on card 50 and soldered. Also, since sub-supporter 611 is cut at joint 612, it is not necessary to always provide sub-supporter 611. That is to say, sub-supporter 611 does not interfere with the electrical connections when it is disposed between pad 50*a* of card 50 and the terminal 70.

Although in this embodiment, connector 60 is formed by press-fitting contact 63, the invention is not limited thereto and the conductive part may be made by plating first plate 61 and second plate 62. In this case,connector 60 is mounted on card 50 by linking a structure of the same material as the first plate 61 and equivalent to insert pin 632 with first plate 61 and providing a latch at the tip to avoid it coming out of the hole of the card 50. A conductive part is connected to the structure which is electrically connected to terminal 70 and soldered to card 50. Moreover, although the sub-supporter is shown attached to the main supporter via joint, the sub-supporter may instead be attached to the first plate via a joint.

Terminal Board (C)

Figure 25:
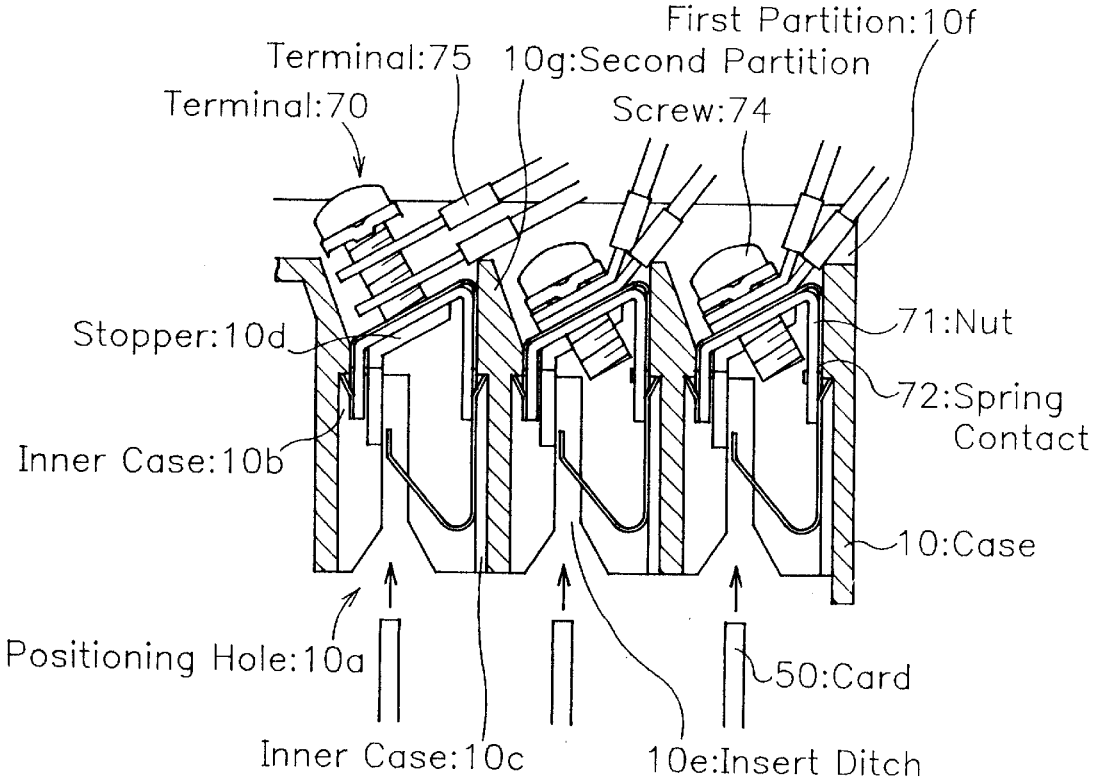
FIG. 25 is a cross sectional view depicting details of a part of the embodiment of FIG. 1.
Figure 26:
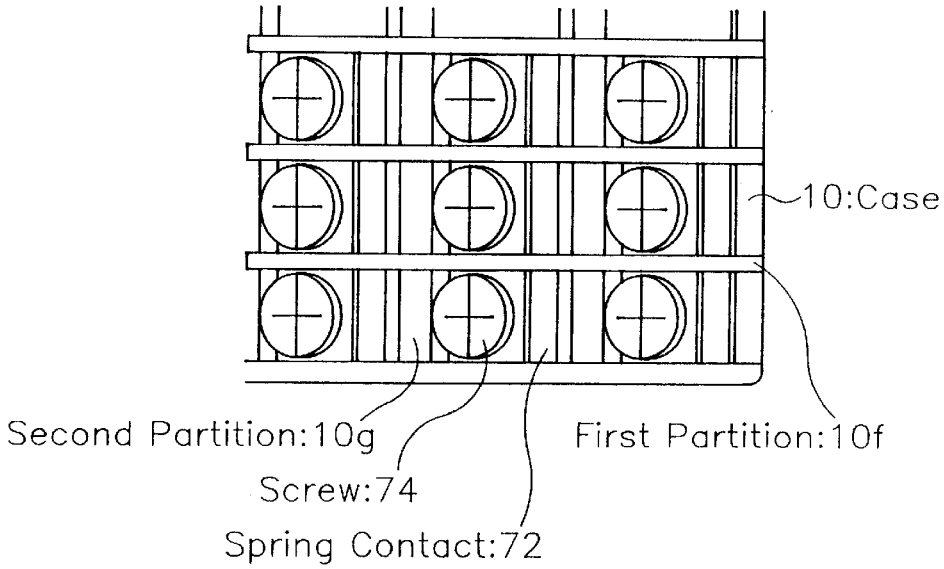
FIG. 26 is a rear view depicting the embodiment of FIG. 1.

FIG. 25 shows details of the embodiment of FIG. 1 and FIG. 26 shows in a rear view the embodiment of FIG. 1 without the connecting terminals or crimp-on lugs. In FIGS. 25 and 26, terminals 70 are provided in case 10 and a fastening plane on which terminals 75, which may be crimp-on lugs, are to be fastened, is formed oblique to the vertical rear plane of case 10. Card 50 has pads, which may be electrodes, not shown, on its surface and are electrically connected to terminals 70.

In case 10, more than one positioning hole 10*a* is provided through the rear thereof at an approximately square cross section and to which terminals 70 are inserted and attached. Inner cases 10*b* and 10*c* are provided counter to positioning hole 10*a*. A stopper 10*d* is provided in each positioning hole 10*a* to retain each terminal 70, respectively. Into each insert channel 10*e*, a card 50 is inserted and guided to each terminal 70 to be electrically connected.

First partitions 10*f* are provided at the extended area of the positioning hole 10*a* to isolate terminal 70 from adjacent terminal 70 and to control the direction of terminals 75 for attachment. Second partitions 10*g* are provided at the extended area of positioning hole 10*a* and are disposed perpendicular to the first partitions 10*f* between terminals 70 to separate adjacent terminals 70. The first and second partitions project from the fastening plane of terminal 70 by a distance of about 2 mm. This projection causes terminals 75 to become deformed toward a direction perpendicular to the fastening plane to prevent contact with adjacent terminals 75, and to maintain a definite clearance from adjacent terminal 70. The nut 71 and spring contact 72 arrangement was already discussed with reference to FIGS. 16 and 17 and no further discussion is needed hereat.

The attaching operation of terminals 75, or crimp-on lugs, in the embodiment, is performed as follows. A terminal 75 is tighened with a screw to nut 71 and spring contact 72 using screw 74. This causes terminal 75 to become deformed because of the second partition 10*g*, and the wiring direction of terminal 75 is changed when terminal 75 is electrically connected to be flat with spring contact 72 by washer 73. That is, the wiring direction of terminal 75 is changed to be perpendicular to the plane of terminals 70 when terminals 75 are tightened with screws 74. In this case, if terminals 70 are provided side by side, terminals 75 will not contact adjacent terminals 70. This enables certain clearance to be maintained between the terminals 70. Accordingly, no gaps need by definitely formed, which advantageously, enables greater reduction in the size of the panel instrument apparatus.

Moreover, since the first and second partitions 10*f*,10*g*, projecting from the fastening plane of terminals 75 can lengthen the creepage distance between adjacent terminals 70, terminals 70 can be provided side by side, which enables further reduction in size of the apparatus. However, the invention is not so limited. For example, although card 50 which is inserted into case 10 is directly connected to terminal 70,another intervening printed circuit board, or card, may be used. Furthermore, although an example of a terminal fitting device comprising nut 71 and spring contact 72 is shown, it may be an integrated fitting.

Terminal Cover

Figure 27:
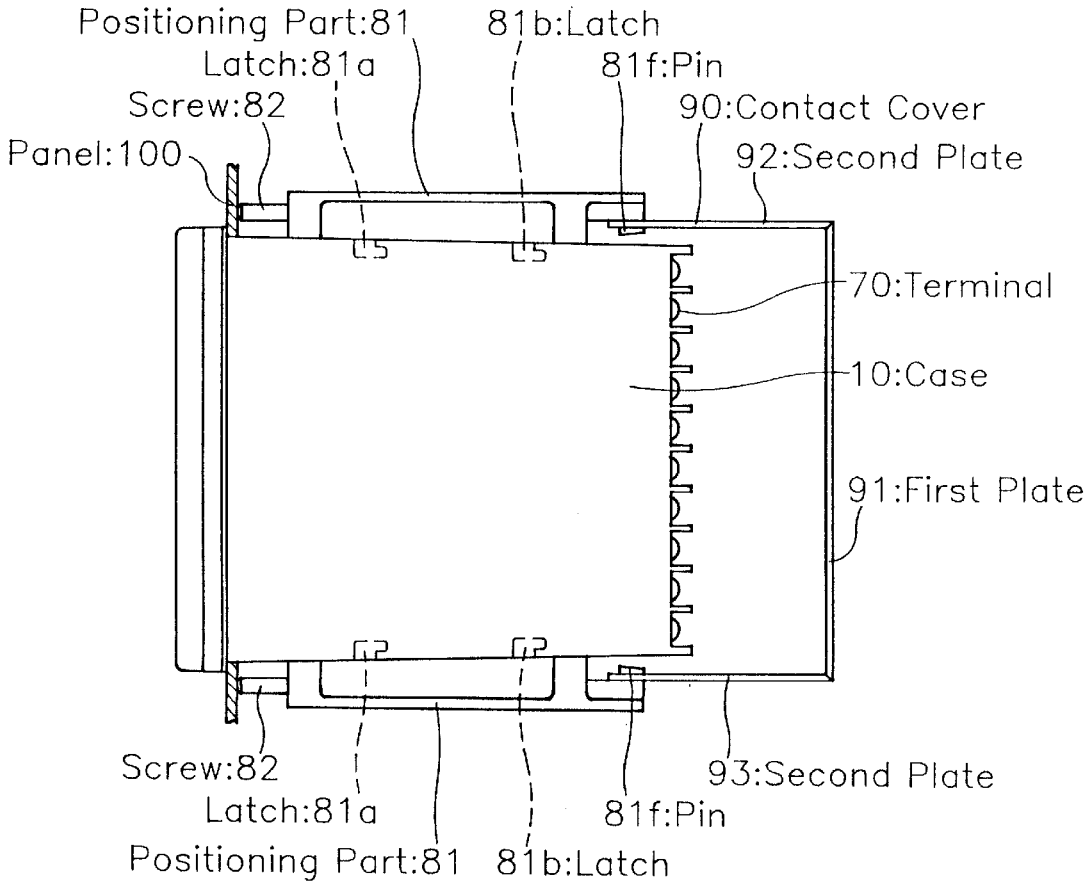
FIG. 27 is a side view depicting details of the embodiment of FIG. 1.
Figure 28:
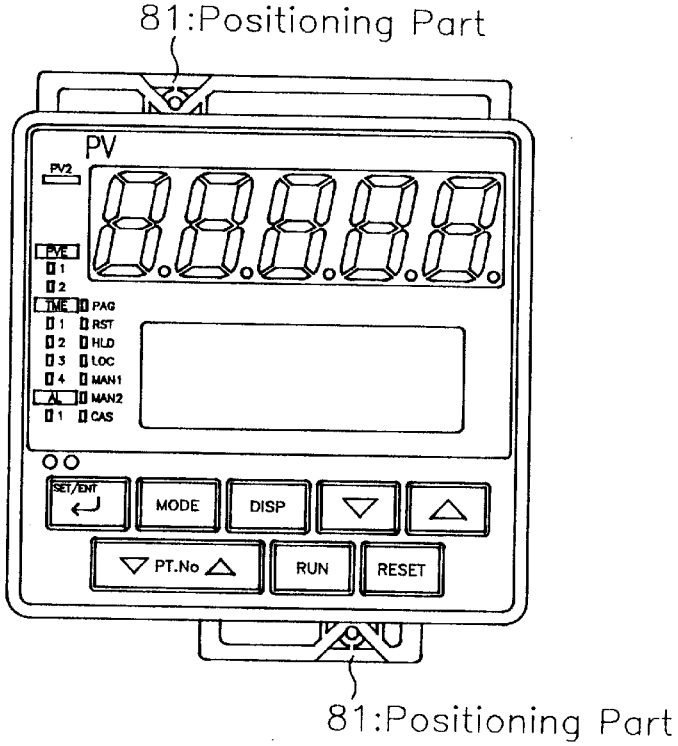
FIG. 28 is a front view depicting details of a part of the embodiment of FIG. 1.

FIGS. 27 and 28 show the embodiment of FIG. 1, wherein case 10 is provided with terminals 70 at the rear and is mounted on panel 100. Positioning parts 81 are provided at the top and bottom of case 10 and have latches 81*a* and 81*b*, pins 81*f* and screws 82. Latches 81*a* or 81*b* are inserted into holes (not shown) provided at the top or bottom of case 10. Positioning parts 81 are the component elements of the upper bracket and lower bracket shown in FIG. 28. Pins 81*f* project toward case 10 and maintain the space between themselves and case 10. Screws 82 fix case 10 to panel 100 by pressing panel 100 against the flange of case 10.

Figure 29:
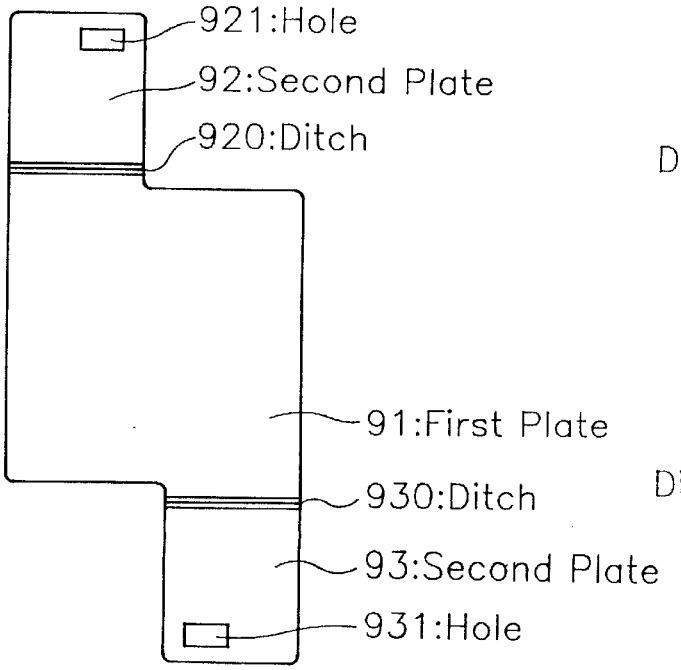
FIGS. 29(*a*) and 29(*b*) are views depicting details of the cover.
Figure 29:
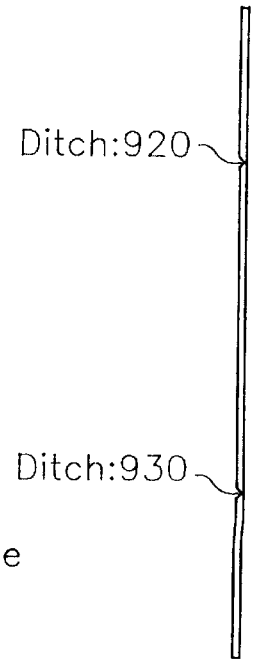

Contact cover 90,formed for example of a polypropylene, comprises first plate 91, second plate 92, 93 and cover terminals 70. The details of contact cover 90 will be described with reference to FIGS. 29(*a*) and 29(*b*) wherein FIG. 29(*a*) is a side view and FIG. 29(*b*) is a plan view. First plate 91 has a surface which is larger than the rear surface of case 10 (see FIG. 27) and covers terminals 70 (see FIG. 27). Second plates 92,93 are provided at both ends of first plate 91 and are capable of being folded into a U-shape at channels 920,930 and have holes 921, 931, respectively, into which pins 81*f* are inserted.

Figure 30:
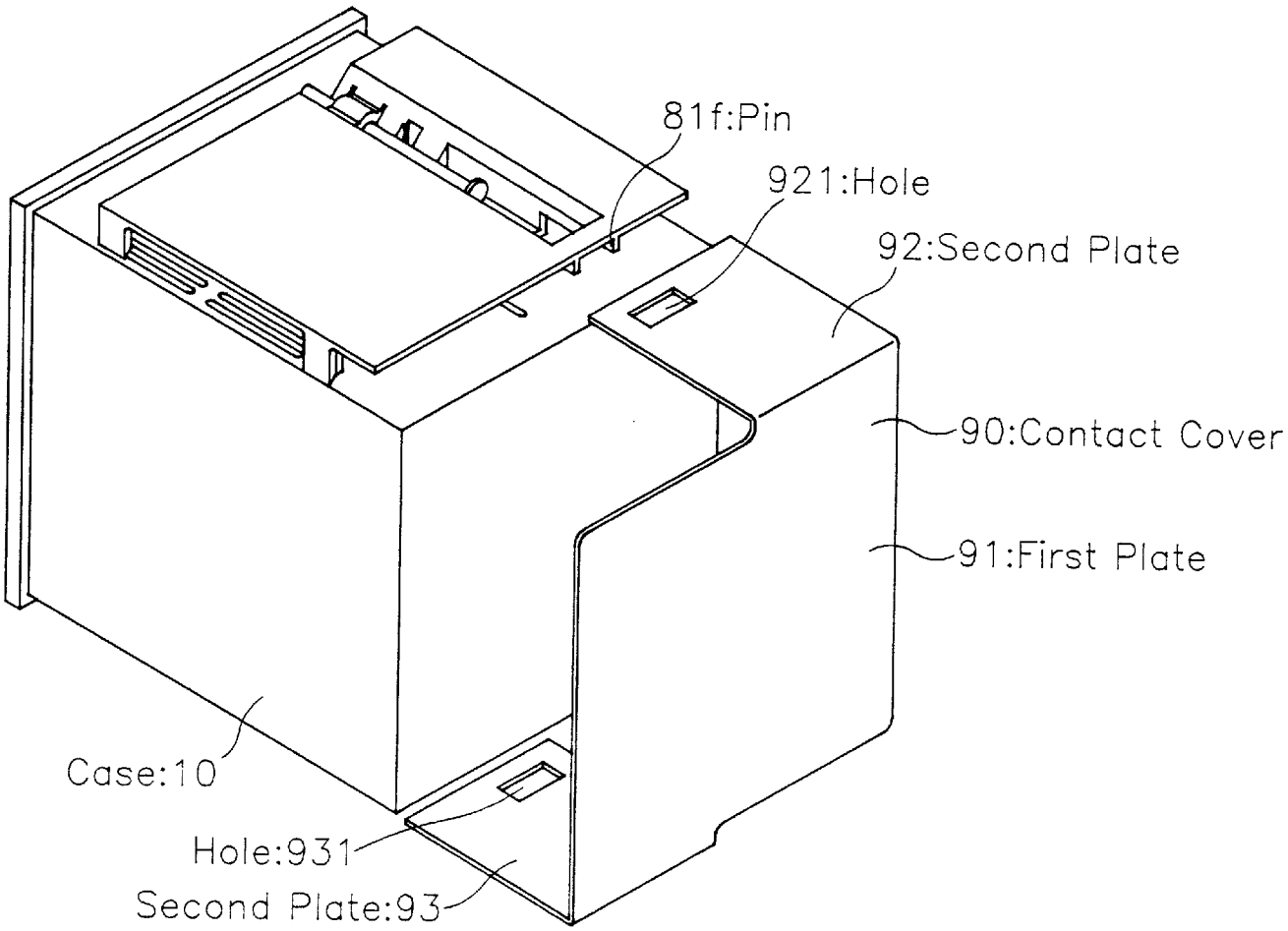
FIG. 30 is a perspective view depicting the assembly of the embodiment.

Operation of the foregoing is as follows. FIG.30 shows the assembly of the parts shown in FIGS. 27 and 28, except that in these figures, the panel indication is omitted. With case 10 fixed to the pael, second plates 92,193 are folded at their channels 920,930, respectively, and form a U together with first plate 91. Pins 81*f* are inserted into holes 921,931, respectively. Since contact cover 90 is formed, for example of polypropylene, contact cover 90 is fixed to the panel instrument by utilizing the resilient force of first plate 91 and second plates 92,93, in the direction of the forming plane. When contact cover 90 is to be removed, second plates 92,93 are pressed inwardly from the top and bottom of the case and pins 81*f* are disengaged from holes 921 and 931.

Since it is not necessary to provide a space for the attaching screws at the rear of the case, a number of added terminals can be provided on the back end face of the case 10. In other words, reduction in size of the apparatus can be readily accomplished with the invention. Also, since screws are not necessary, the possibility of losing the screws can be eliminated and thereby make the removal of the cover more possible with easy.

Although the positioning parts 81 are provided at the top and bottom of case 10, the positioning parts 81 can be provided on both the right and left sides of case 10.

Bracket

Figure 31:
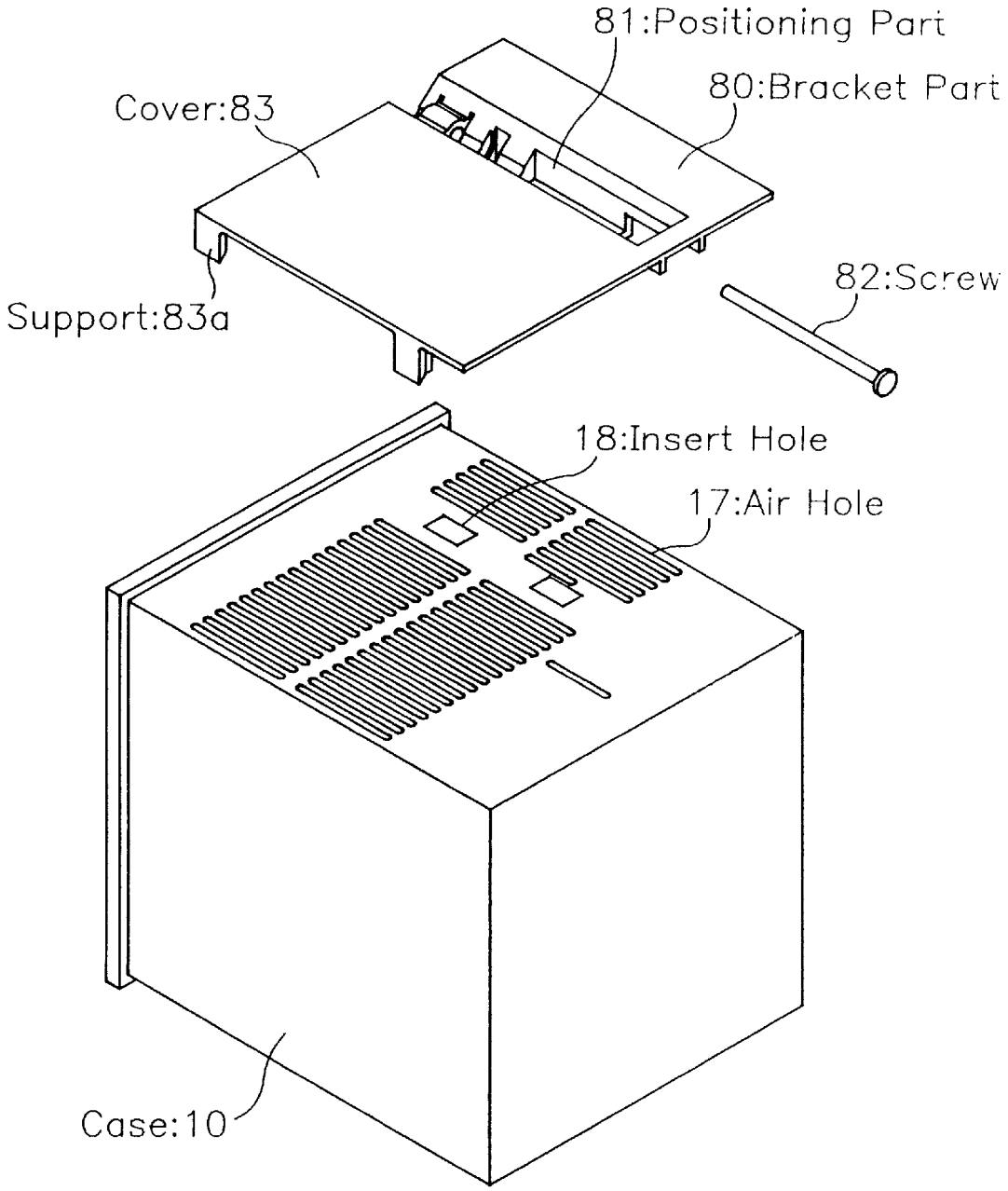
FIG. 31 is an exploded perspective view depicting the embodiment of FIG. 1 with the cover removed.
Figure 32:
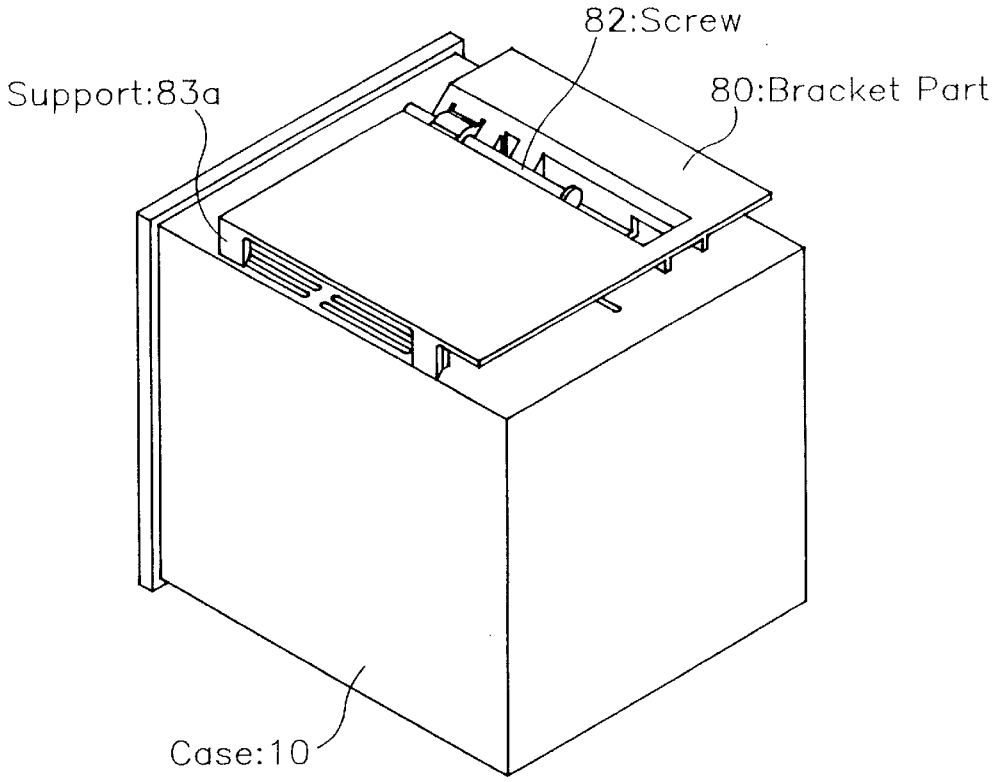
FIG. 32 is a perspective view depicting the embodiment of FIG. 1 with the cover in place.

FIGS. 31 and 32 show the embodiment of FIG. 1 with the brackets disassembled and assembled, respectively. The width at the front of the top and bottom surfaces of case 10 of the panel instrument are made wider than that at the rear, and also, the height at the front between the top and bottom surfaces is made higher than at the rear. Of course, other relative measurements can be used. The top and bottom surfaces are provided with multiple air holes 17, and have insert holes 18,respectively. Bracket parts 80 are attached to case 10 by inserting latches to insert holes 18 on the top and bottom surfaces of case 10. Thus, case 10 is mounted on a panel (not shown) with bracket parts 80.

Figure 33:
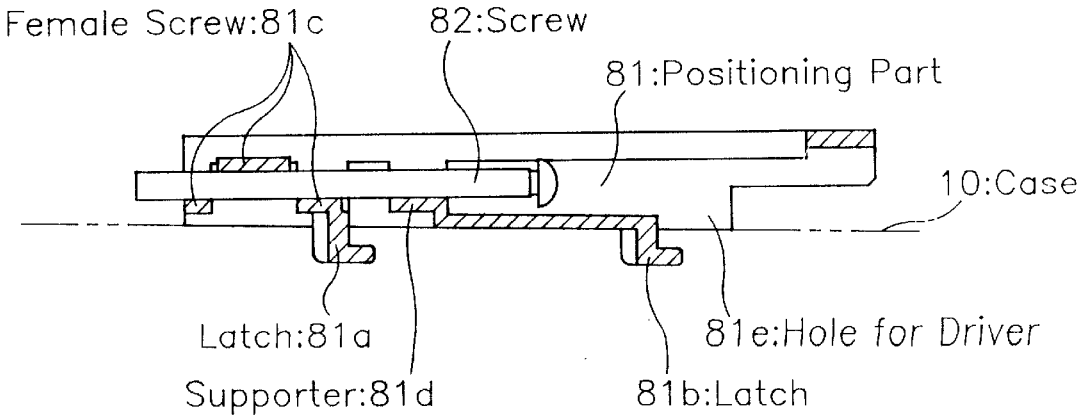
FIG. 33 is a cross sectional view depicting details of the bracket.
Figure 34:
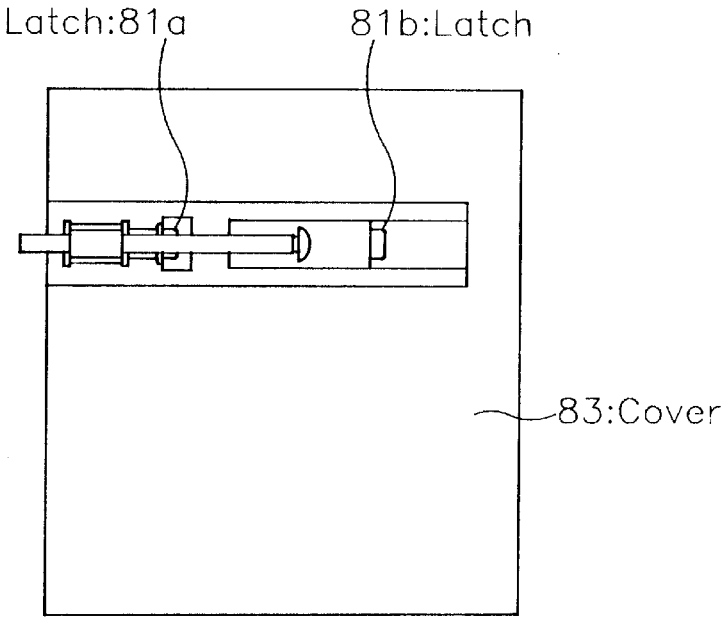
FIG. 34 is a plan view depicting the configuration of the bracket.
Figure 35:
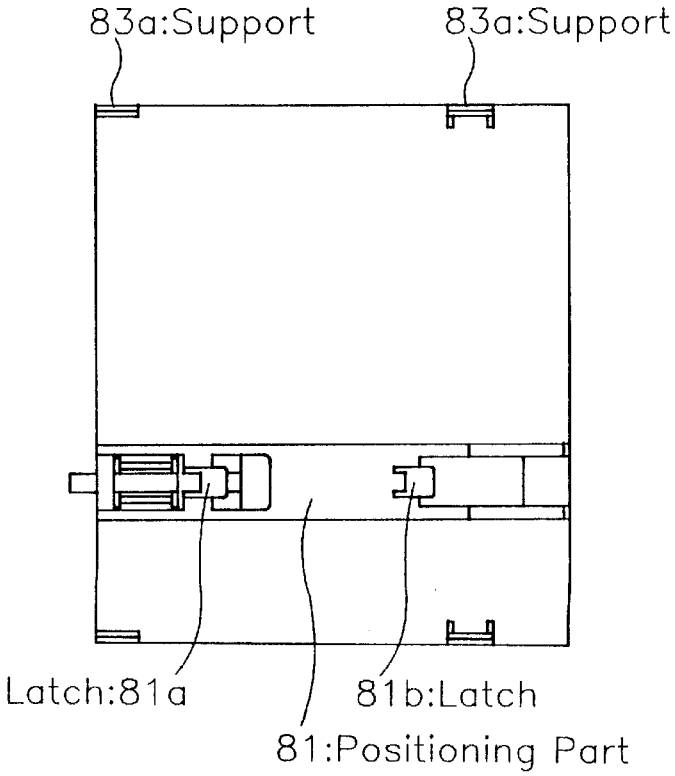
FIG. 35 is a bottom view depicting details of the bracket.

FIG. 33 shows a cross section of bracket part 80. FIG. 34 shows a plan view thereof. FIG. 35 shows a bottom view thereof. In FIGS. 33,34,35, positioning part 81 forms an approximate rectangular shape comprising latches 81*a* and 81*b*, female screw 81*c*, supporter 81*d*, and a hole for tool 81*e*. The bottom surface of positioning part 81 has a slope at the same angle as that of the top surface of case 10 so that screw 82 is inserted perpendicular to the panel. Latches 81*a* and 81*b* are provided at the bottom of positioning part 81 and are inserted into holes 18 provided on case 10, and positioning part 81 is mounted on case 10. Female screw 8l*c* is provided at the front end of positioning part 81 to which screw 81 is attached. Supporter 81*d* is provided at the back end of female screw 81*c*, supports screw 82 screwed into female screw 81*c*, and, concurrently, prevents a shift of the propelling axis of screw 82 when screw 81 is tightened. A hole 81*e* for a tool, such as a screwdriver, is provided at the back end of positioning part 81 to insert a screwdriver, not shown,for tightening or loosening screw 82.

Cover 83 is linked with positioning part 81 and covering air holes 17 of case 10 and leaving a space between cover 83 and the air holes 17. Supports 83*a* support cover 83 so that a space is provided between the top of case 10 and cover 83.

Although not shown, a bracket is also provided under the bottom of case 10. The bracket may take the same configuration as above discussed, but, it is generally configured with positioning part 81 only, and without the cover 83.

Operation of the foregoing component is as follows. A panel instrument, for example a case 10, is inserted into a panel cut-out and latches 81*a* and 81*b* of bracket part 80 are inserted into insert holes 18 on the top surface of case 10 to latch the bracket. Then, screw 82 is tightened with a tool, such as screwdriver,inserted through hole 81*e*. Case 10 is fixed to the panel by securing the panel to the flange of case 10 using screw 82. In other words, the attachment is achieved by pressing screw 82 against the panel.

Heat generated by circuits inside of case 10 is dissipated through holes 17 provided on the top surface of case 10. Heat from the air holes 17 is diffused into the surrounding air through the space between the top of case 10 and the cover 83 of bracket part 80. Cover 83 of bracket part 80 acts to prevent air holes 17 of case 10 from becoming clogged with dust or other components, such as cables, and to prevent dust from getting inside the panel instrument apparatus. This ensures reliable heat dissipation.

The top and bottom surfaces of case 10 can be sloped from the front to the rear, respectively, to facilitate manufacture by injection molding, for example. If the positioning part does not have a slope at its bottom, and is attached to case 10, screw 82 cannot press on the panel perpendicularly. Hence, the force from the screw is distributed to weaken the fixing force, and a part of the force is applied to case 10. This may cause deformation of case 10 by warping of the inside of the case 10. If case 10 warps, printed circuit boards accommodated in case 10 may be difficult to remove. Hence, the bottom surface of positioning part 81 is also sloped. This causes screw 82 to press on the panel surface perpendicularly without distributing the force of screw 82 and thus insures that the case 10 can be fixed to the panel. Also, there is no possibility then of deformation of case 10 by warping toward the inside of the case 10.

Even if screw 82 is not pressed on the panel in a perpendicular manner, depending on the condition of the work, supporter 81*d* does not cause the propelling axis of screw 82 to become tilted toward the instrument. Thus, there is no possibility of deformation of the case 10 by warping.

Although the bracket part 80 is shown fixed to case 10 by inserting latches 81*a* and 81*b* into inserting holes 18, the invention in not so limited. For example, the bracket part 80 may be fixed to case 10 using screws.

In addition, supports 83 are shown to be provided to support cover 83. However, such supports are not necessary. The invention only requires that there be a space between the top of case 10 a cover 83.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A panel apparatus comprising:

a printed circuit board having a flat front face and mounted on a surface of said flat front face a plurality of light emitting elements and at separate locations therefrom a plurality of corresponding switches; and a panel cover having a rear part, said flat front face of said printed circuit board being removably attached to said rear part of said panel cover; wherein said panel cover comprises a flat surface incorporating therein a plurality of resilient links and a plurality of movable keys coupled to said plurality of resilient links and being disposed at positions corresponding to and movable against resilient force of said resilient links to selectively operate said plurality of said switches on said printed circuit board thereby to selectively operate corresponding ones of said plurality of light emitting elements; and wherein said panel cover is provided with a plurality of reflecting holes therein arranged at positions corresponding to said plurality of light emitting elements on said printed circuit board so that light from said light emitting elements is emitted through said reflecting holes.

2. A panel apparatus comprising:

a panel cover comprising a plurality of reflecting holes for guiding light from a rear thereof to a front thereof, a plurality of resilient links, and a plurality of keys formed on said front and coupled to said resilient links to form connecting circuits;

a plurality of light emitting elements arranged at said rear of said panel cover at locations corresponding to said plurality of reflecting holes; and a plurality of contact means operable upon pressing of said keys against resilient force of said resilient links to selectively connect with said contact means and thereby selectively operate ones of said plurality of light emitting elements and cause light to be emitted through the corresponding reflecting holes.

3. The apparatus of claim 1, wherein said plurality of reflecting holes are removable from said panel cover.

4. The apparatus of claim 2, wherein said plurality of reflecting holes are removable from said panel cover.

5. The apparatus of claim 1, wherein said panel cover comprises:

a panel sheet on which data is imprinted or embossed at locations corresponding to locations of said plurality of light emitting elements.

6. The apparatus of claim 2, wherein said panel cover comprises:

a panel sheet on which data is imprinted or embossed at locations corresponding to locations of said plurality of light emitting elements.

7. The apparatus of claim 3, wherein said panel cover comprises:

a panel sheet on which data is imprinted or embossed at locations corresponding to locations of said plurality of light emitting elements.

8. The apparatus of claim 4, wherein said panel cover comprises:

a panel sheet on which data is imprinted or embossed at locations corresponding to locations of said plurality of light emitting elements.

9. A panel apparatus comprising:

a panel;

a case; and a panel cover removable from said case; wherein said panel cover comprises: an attaching part; a latching means; a knob means, said knob means for removing said panel cover from said case by pressing said latch means; and said case comprises: an enclosure having an attaching means; a first gasket provided at said attaching means for attaching to said panel; and a second gasket provided at said attaching part of said panel cover for attaching to said enclosure and whereby said knob means is covered thereby.

10. The apparatus of claim 9, wherein said second gasket comprises:

switching means forming a channel means into which a tool is inserted; and spring means coupled to said switching means; and wherein said panel cover and said case are separated by inserting said tool into said channel means and by turning said tool while concurrently providing force thereto.

11. A panel apparatus comprising:

a plurality of terminals;

a case;

a printed circuit board comprising a card edge connector formed thereon and electrically connected to said plurality of terminals, said plurality of terminals being provided at a rear of said case;

a second plate;

a first plate having one end thereof formed perpendicular to said second plate, said first plate being mounted perpendicular to said printed circuit board;

a connector comprising a pad electrically connected to said printed circuit board and located in a position where said second plate is disposed in parallel to said card edge connector of said printed circuit board; and said connector is connected to said plurality of terminals.

12. The apparatus of claim 1, further comprising:

a main supporter means linked perpendicular to another end of said first plate in a direction opposite to said second plate; and a subsupporter means linked perpendicular to said main supporter means or to said other end of said first plate in a same direction as said second plate.

13. A panel apparatus comprising:

a plurality of terminals having a fastening plane disposed at an angle to an array plane of said plurality of terminals and to which said plurality of terminals are fastened;

first partition means for separating said plurality of terminals and for controlling attaching direction of said plurality of terminals; and second partition means for separating adjacent ones of said plurality of terminals, said second partition means being provided perpendicular to said first partition means; wherein said second partition means projects from said terminal fastening plane, and said plurality of terminals are deformed in a direction perpendicular to said array plane, so that said plurality of terminals are prevented from contacting adjacent ones of said plurality of terminals and a predetermined clearance is maintained therebetween.

14. A panel apparatus comprising:

a panel;

a case having a top, a bottom two sides and a back end plane;

a plurality of terminals arranged on said back end plane;

a plurality of positioning means provided at said top and bottom or on both said sides of said case, and comprising: pins projecting toward said case and maintaining a predetermined spacing between said plurality of positioning means and said case, and screws for fixing said case by applying force to said case and thereby holding said case against said panel; and a terminal cover means comprising a first plate means for covering said plurality of terminals, and a second plate means provided at both ends of said first plate, each said end having a hole into which said pins are inserted and each said end being formed in a U-shape by said first plate and second plate; and wherein said second plate means acts toward an outside so as to define a plane together with said first plate means and so as to fix said terminal cover.

15. A panel apparatus comprising:

a case having a top surface having a plurality of air holes therein;

a panel; and bracket means attached to said case; wherein said bracket means comprises:

positioning means attached to said panel apparatus, said positioning means comprising screw means for holding said panel against said panel apparatus; and cover means mounted on said positioning means for covering said air holes in said top surface and for maintaining a space between said cover means and said air holes.

16. A panel apparatus comprising:

a printed circuit board having a flat front face and mounted at a surface of said flat front face a plurality of light emitting elements and at separate locations on said surface of said flat face a plurality of corresponding switches; and a panel cover having a rear part, said flat front face of said prined circuit board being removably attached to said rear part of said panel cover; wherein said panel cover is provided with a plurality of reflecting holes arranged at positions corresponding to said plurality of light emitting elements on said printed circuit board for guiding light emitted by said light emitting element; and wherein resilient key means are provided for selectively operating said switches to thereby cause selected ones of said plurality of light emitting elements to emit light through corresponding ones of said plurality of reflecting holes.

17. The apparatus of claim 16, wherein said plurality of reflecting holes are removable from said panel cover.

18. The apparatus of claim 16, wherein said panel cover comprises a panel sheet on which data is imprinted or embossed at locations corresponding to locations of said plurality of light emitting elements.

19. The apparatus of claim 17, wherein said panel cover comprises a panel sheet on which data is imprinted or embossed at locations corresponding to locations of said plurality of light emitting elements.

20. A panel apparatus comprising:

a case;

a plurality of terminals provided at a rear of said case;

a printed circuit board having a card edge connector formed thereon and electrically connected to said plurality of terminals;

a first plate;

a second plate;

said first plate having one end thereof formed perpendicular to said second plate;

said first plate being mounted perpendicular to said printed circuit board; and a connector comprising a pad electrically connected to said printed circuit board and located in a position where said second plate is in parallel with said card edge connector of said printed circuit board; wherein said connector is connected to said plurality of terminals.

* * * * *